US011485147B2

(12) United States Patent
Hoshi

(10) Patent No.: US 11,485,147 B2
(45) Date of Patent: Nov. 1, 2022

(54) DRAWING METHOD, HEAT-SENSITIVE RECORDING MEDIUM, AND DRAWING DEVICE

(71) Applicant: Sony Corporation, Tokyo (JP)

(72) Inventor: Mitsunari Hoshi, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 17/275,049

(22) PCT Filed: Aug. 7, 2019

(86) PCT No.: PCT/JP2019/031167
§ 371 (c)(1),
(2) Date: Mar. 10, 2021

(87) PCT Pub. No.: WO2020/054279
PCT Pub. Date: Mar. 19, 2020

(65) Prior Publication Data

US 2022/0055375 A1 Feb. 24, 2022

(30) Foreign Application Priority Data

Sep. 11, 2018 (JP) ..... JP2018-170076

(51) Int. Cl.
*B41J 2/475* (2006.01)
*B41M 5/30* (2006.01)
(Continued)

(52) U.S. Cl.
CPC ..... *B41J 2/4753* (2013.01); *B41J 2/475* (2013.01); *B41M 5/30* (2013.01); *B41M 5/305* (2013.01);
(Continued)

(58) Field of Classification Search
CPC .. B41J 2/475; B41J 2/4753; B41J 2002/4756; B41M 5/30; B41M 5/305; B41M 5/323;
(Continued)

(56) References Cited

U.S. PATENT DOCUMENTS 5,692,109 A 11/1997 Shu
6,313,857 B1 11/2001 Shimizu
(Continued)

FOREIGN PATENT DOCUMENTS

CN 102666111 A 9/2012
CN 103660561 A 3/2014
(Continued)

OTHER PUBLICATIONS

International Search Report dated Sep. 10, 2019 in connection with PCT/JP2019/031167.

*Primary Examiner* — Matthew Luu
*Assistant Examiner* — Kendrick X Liu
(74) *Attorney, Agent, or Firm* — K&L Gates LLP

(57) ABSTRACT

A drawing method according to an embodiment of the present disclosure to be performed on a heat-sensitive recording medium including a recording layer, the recording layer containing a leuco dye and a photothermal conversion agent that absorbs infrared wavelength light, includes: performing drawing in a plurality of first regions, the plurality of first regions each extending in one direction and having gaps therebetween; and thereafter detecting recorded states of the plurality of first regions, calculating differences from the input image information, and performing drawing in a
(Continued)

plurality of second regions at recording intensities determined on a basis of the differences, the plurality of second regions each extending in the one direction and being provided at the gaps between the plurality of first regions.

5 Claims, 15 Drawing Sheets

(51) Int. Cl.
*B41M 5/323* (2006.01)
*B41M 5/333* (2006.01)
*B41M 5/46* (2006.01)

(52) U.S. Cl.
CPC ..... *B41M 5/323* (2013.01); *B41M 5/333* (2013.01); *B41M 5/3331* (2013.01); *B41M 5/46* (2013.01); *B41M 5/465* (2013.01); *B41J 2002/4756* (2013.01)

(58) Field of Classification Search
CPC ..... B41M 5/333; B41M 5/3331; B41M 5/46; B41M 5/465
See application file for complete search history.

(56) References Cited

U.S. PATENT DOCUMENTS

| | | | | |
|---|---|---|---|---|
| 8,888,215 | B2 | 11/2014 | Mitsui | |
| 2007/0225162 | A1* | 9/2007 | Kawahara | B41M 5/305 503/201 |
| 2011/0156382 | A1 | 6/2011 | Uyttendaele | |
| 2012/0200656 | A1 | 8/2012 | Oda | |
| 2012/0212564 | A1* | 8/2012 | Yamamoto | B41M 5/284 347/225 |
| 2018/0326744 | A1* | 11/2018 | Sawamura | B41J 2/473 |

FOREIGN PATENT DOCUMENTS

| | | | |
|---|---|---|---|
| JP | H0884253 | A | 3/1996 |
| JP | H08132654 | A | 5/1996 |
| JP | H11170589 | A | 6/1999 |
| JP | 2004188827 | A | 7/2004 |
| JP | 2004249541 | A | 9/2004 |
| JP | 2011104990 | A | 6/2011 |
| JP | 2011156382 | A | 8/2011 |
| JP | 2013215886 | A | 10/2013 |
| JP | 2014047443 | A | 3/2014 |

* cited by examiner

[ FIG. 1 ]
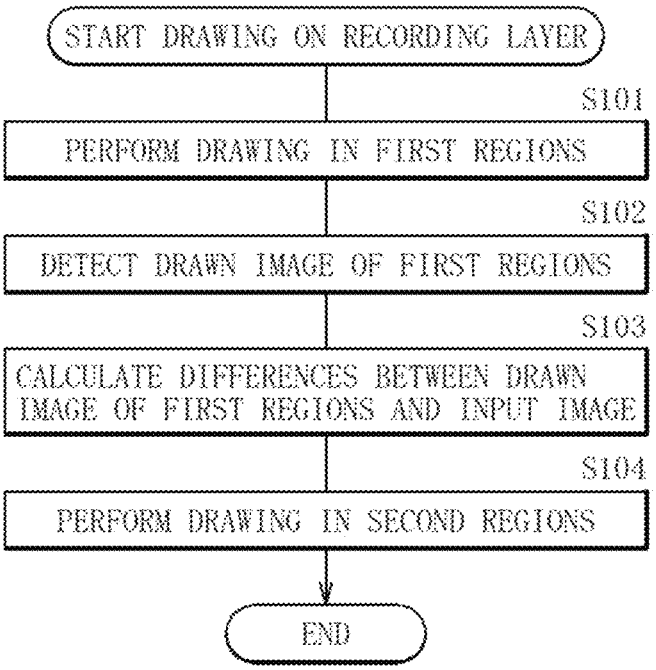
[ FIG. 2 ]
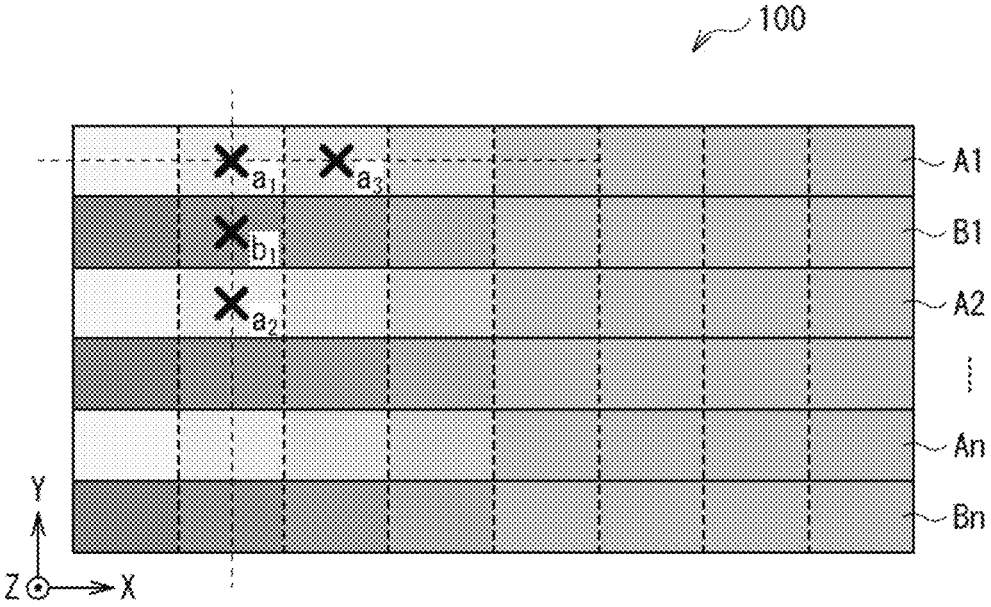

[ FIG. 5 ]
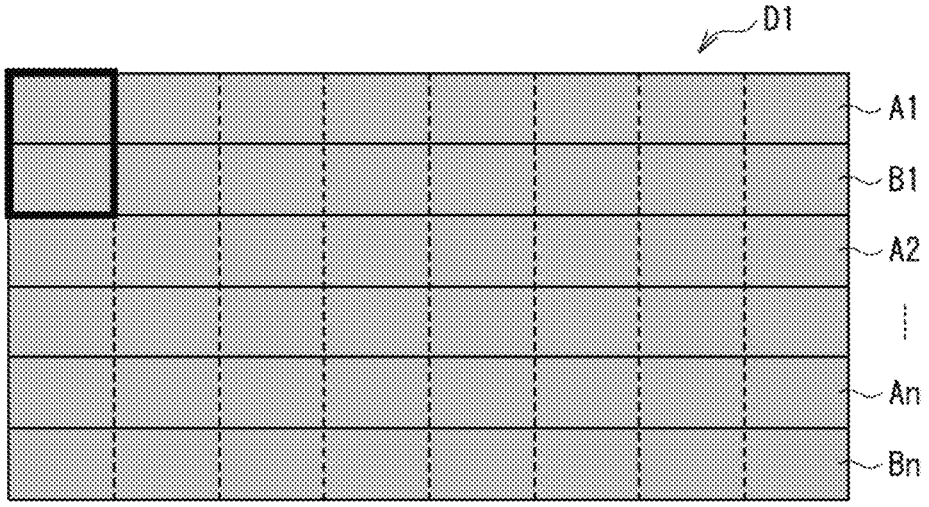
[ FIG. 6A ]
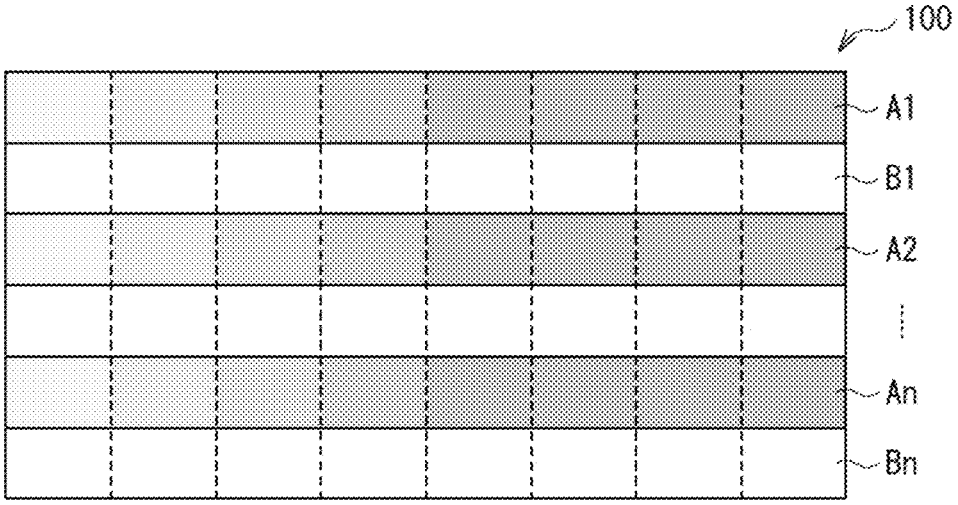
[ FIG. 6B ]
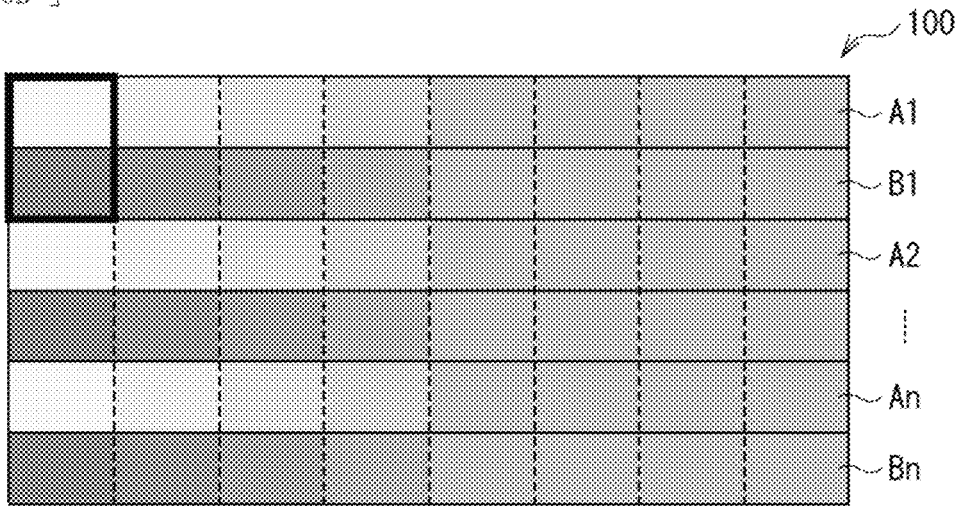

[ FIG. 7 ]
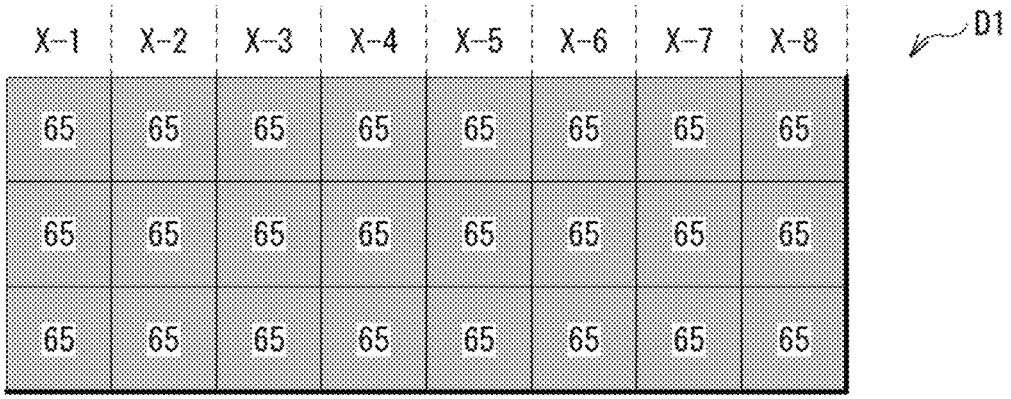
[ FIG. 8 ]
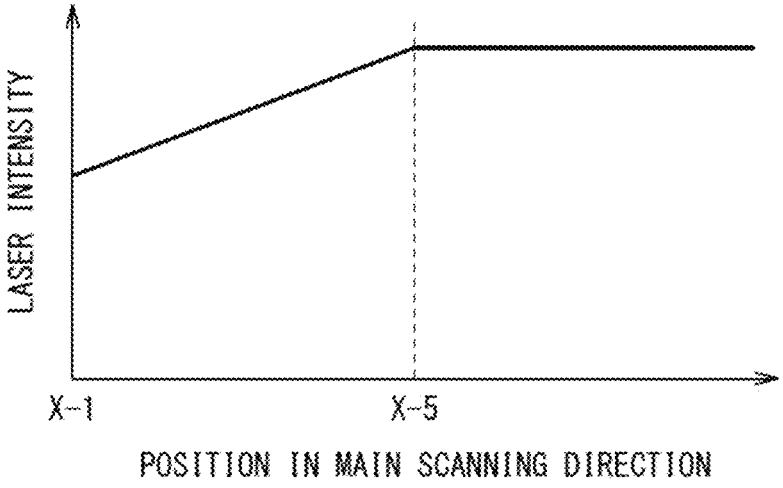

[ FIG. 9 ]
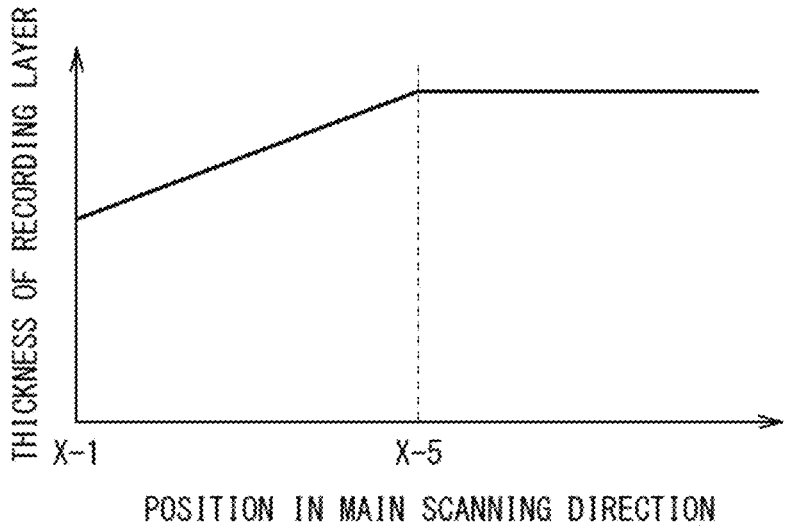
[ FIG. 10 ]
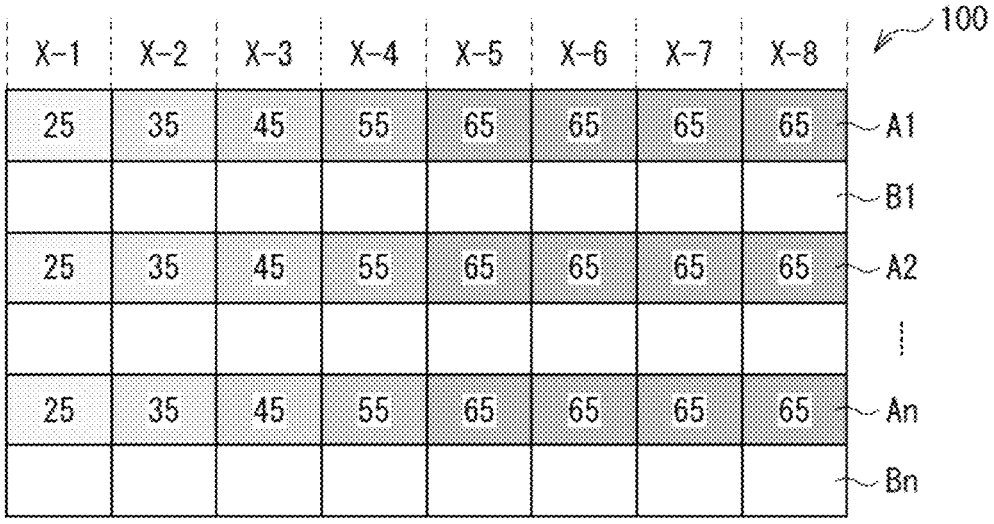
| X-1 | X-2 | X-3 | X-4 | X-5 | X-6 | X-7 | X-8 | |
|---|---|---|---|---|---|---|---|---|
| 25 | 35 | 45 | 55 | 65 | 65 | 65 | 65 | A1 |
| | | | | | | | | B1 |
| 25 | 35 | 45 | 55 | 65 | 65 | 65 | 65 | A2 |
| | | | | | | | | ⋮ |
| 25 | 35 | 45 | 55 | 65 | 65 | 65 | 65 | An |
| | | | | | | | | Bn |

[ FIG. 11 ]
100
| X-1 | X-2 | X-3 | X-4 | X-5 | X-6 | X-7 | X-8 | |
|---|---|---|---|---|---|---|---|---|
| 25 | 35 | 45 | 55 | 65 | 65 | 65 | 65 | A1 |
| 105 | 95 | 85 | 75 | 65 | 65 | 65 | 65 | B1 |
| 25 | 35 | 45 | 55 | 65 | 65 | 65 | 65 | A2 |
| 105 | 95 | 85 | 75 | 65 | 65 | 65 | 65 | ⋮ |
| 25 | 35 | 45 | 55 | 65 | 65 | 65 | 65 | An |
| 105 | 95 | 85 | 75 | 65 | 65 | 65 | 65 | Bn |
[ FIG. 12 ]
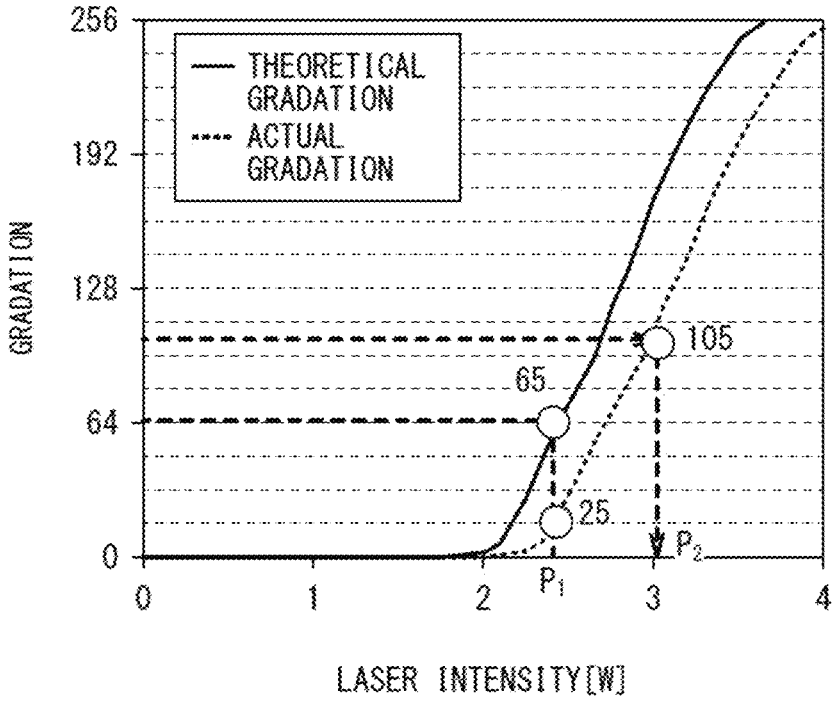

[ FIG. 13 ]
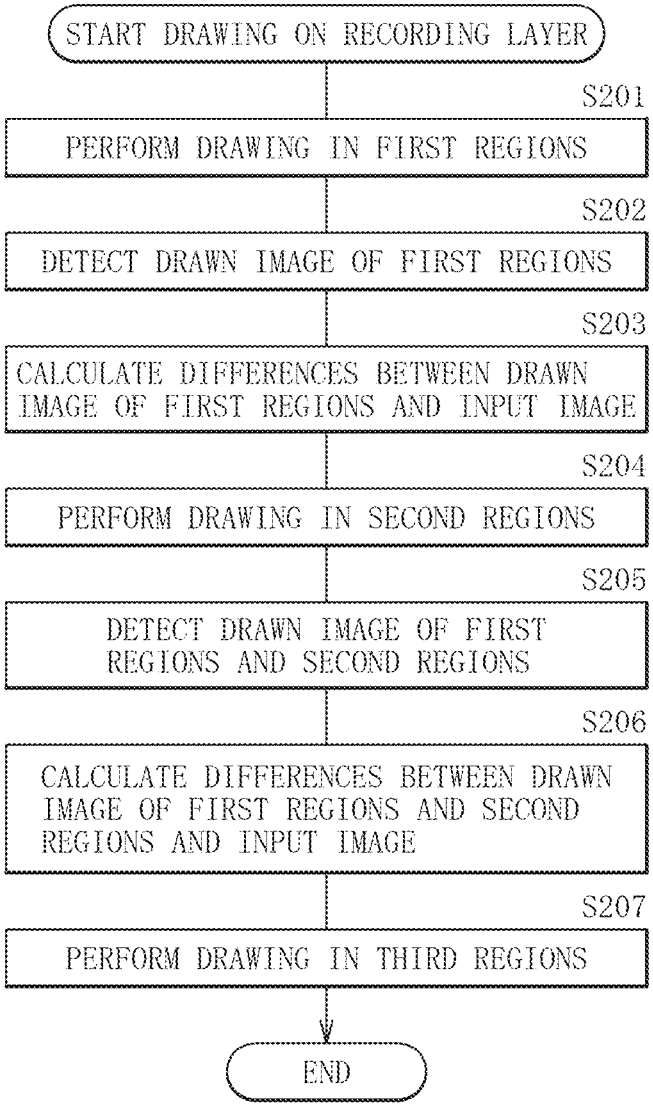

[ FIG. 14A ]

| | | | | | | | | |
|---|---|---|---|---|---|---|---|---|
| 25 | 35 | 45 | 55 | 65 | 65 | 65 | 65 | A1 |
| | | | | | | | | B1 |
| | | | | | | | | C1 |
| 25 | 35 | 45 | 55 | 65 | 65 | 65 | 65 | A2 |
| | | | | | | | | B2 |
| | | | | | | | | ⋮ |
| 25 | 35 | 45 | 55 | 65 | 65 | 65 | 65 | An |
| | | | | | | | | Bn |
| | | | | | | | | Cn |

100

[ FIG. 14B ]

| | | | | | | | | |
|---|---|---|---|---|---|---|---|---|
| 25 | 35 | 45 | 55 | 65 | 65 | 65 | 65 | A1 |
| 105 | 95 | 85 | 75 | 65 | 65 | 65 | 65 | B1 |
| | | | | | | | | C1 |
| 25 | 35 | 45 | 55 | 65 | 65 | 65 | 65 | A2 |
| 105 | 95 | 85 | 75 | 65 | 65 | 65 | 65 | B2 |
| | | | | | | | | ⋮ |
| 25 | 35 | 45 | 55 | 65 | 65 | 65 | 65 | An |
| 105 | 95 | 85 | 75 | 65 | 65 | 65 | 65 | Bn |
| | | | | | | | | Cn |

100

[ FIG. 14C ]

| | | | | | | | | |
|---|---|---|---|---|---|---|---|---|
| 25 | 35 | 45 | 55 | 65 | 65 | 65 | 65 | A1 |
| 105 | 95 | 85 | 75 | 65 | 65 | 65 | 65 | B1 |
| 65 | 65 | 65 | 65 | 65 | 65 | 65 | 65 | C1 |
| 25 | 35 | 45 | 55 | 65 | 65 | 65 | 65 | A2 |
| 105 | 95 | 85 | 75 | 65 | 65 | 65 | 65 | B2 |
| 65 | 65 | 65 | 65 | 65 | 65 | 65 | 65 | ⋮ |
| 25 | 35 | 45 | 55 | 65 | 65 | 65 | 65 | An |
| 105 | 95 | 85 | 75 | 65 | 65 | 65 | 65 | Bn |
| 65 | 65 | 65 | 65 | 65 | 65 | 65 | 65 | Cn |

100

[ FIG. 15A ]

| | | | | | | | | |
|---|---|---|---|---|---|---|---|---|
| 25 | 35 | 45 | 55 | 65 | 65 | 65 | 65 | A1 |
| | | | | | | | | B1 |
| | | | | | | | | C1 |
| 25 | 35 | 45 | 55 | 65 | 65 | 65 | 65 | A2 |
| | | | | | | | | B2 |
| | | | | | | | | ⋮ |
| 25 | 35 | 45 | 55 | 65 | 65 | 65 | 65 | An |
| | | | | | | | | Bn |
| | | | | | | | | Cn |

100

[ FIG. 15B ]

| | | | | | | | | |
|---|---|---|---|---|---|---|---|---|
| 25 | 35 | 45 | 55 | 65 | 65 | 65 | 65 | A1 |
| 125 | 110 | 95 | 80 | 65 | 65 | 65 | 65 | B1 |
| | | | | | | | | C1 |
| 25 | 35 | 45 | 55 | 65 | 65 | 65 | 65 | A2 |
| 125 | 110 | 95 | 80 | 65 | 65 | 65 | 65 | B2 |
| | | | | | | | | ⋮ |
| 25 | 35 | 45 | 55 | 65 | 65 | 65 | 65 | An |
| 125 | 110 | 95 | 80 | 65 | 65 | 65 | 65 | Bn |
| | | | | | | | | Cn |

100

[ FIG. 15C ]

| | | | | | | | | |
|---|---|---|---|---|---|---|---|---|
| 25 | 35 | 45 | 55 | 65 | 65 | 65 | 65 | A1 |
| 125 | 110 | 95 | 80 | 65 | 65 | 65 | 65 | B1 |
| 45 | 50 | 55 | 60 | 65 | 65 | 65 | 65 | C1 |
| 25 | 35 | 45 | 55 | 65 | 65 | 65 | 65 | A2 |
| 125 | 110 | 95 | 80 | 65 | 65 | 65 | 65 | B2 |
| 45 | 50 | 55 | 60 | 65 | 65 | 65 | 65 | ⋮ |
| 25 | 35 | 45 | 55 | 65 | 65 | 65 | 65 | An |
| 125 | 110 | 95 | 80 | 65 | 65 | 65 | 65 | Bn |
| 45 | 50 | 55 | 60 | 65 | 65 | 65 | 65 | Cn |

100

[ FIG. 16A ]
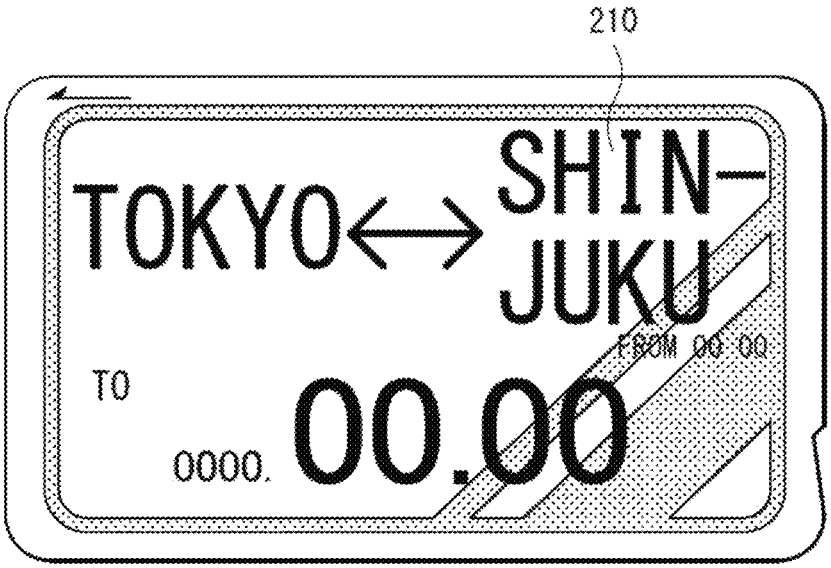
[ FIG. 16B ]
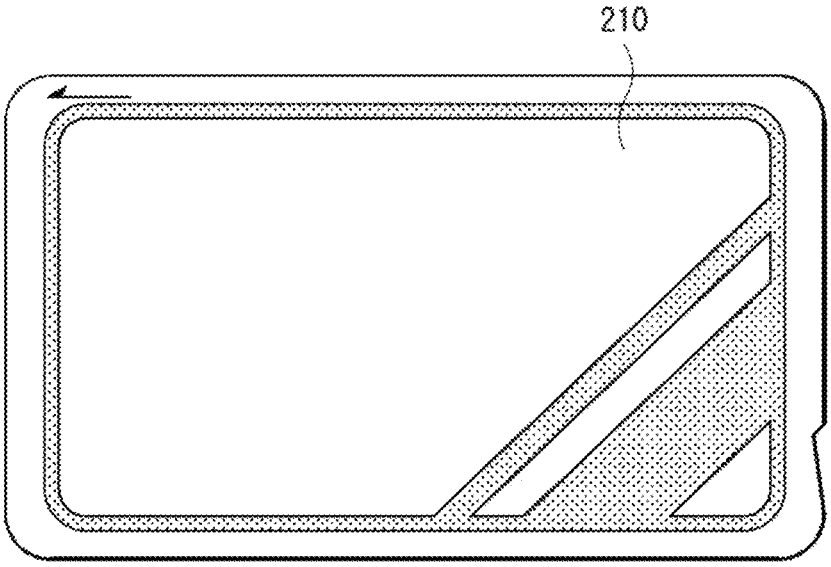

[ FIG. 17A ]
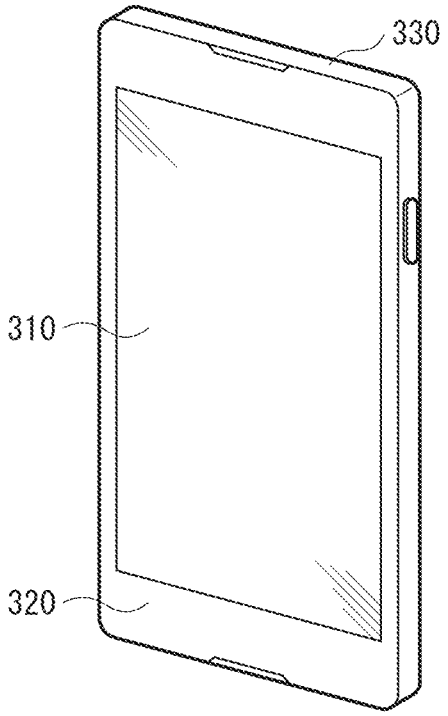
[ FIG. 17B ]
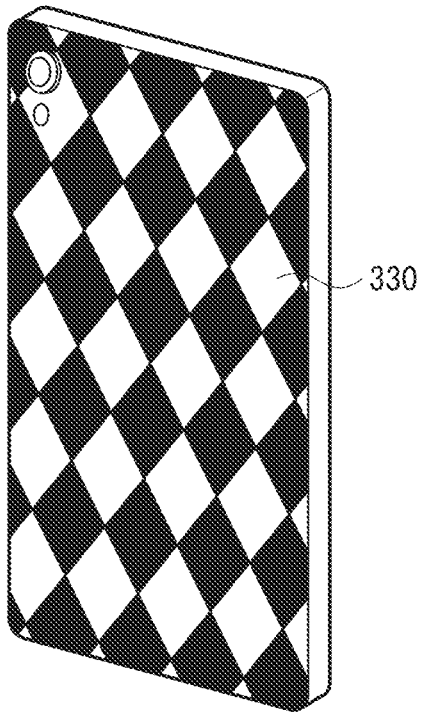

[ FIG. 18A ]
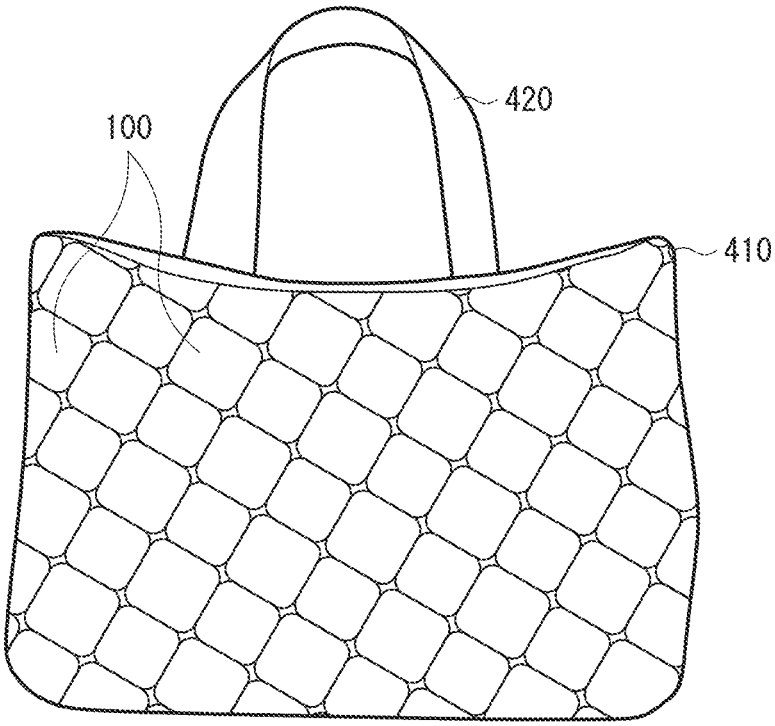
[ FIG. 18B ]
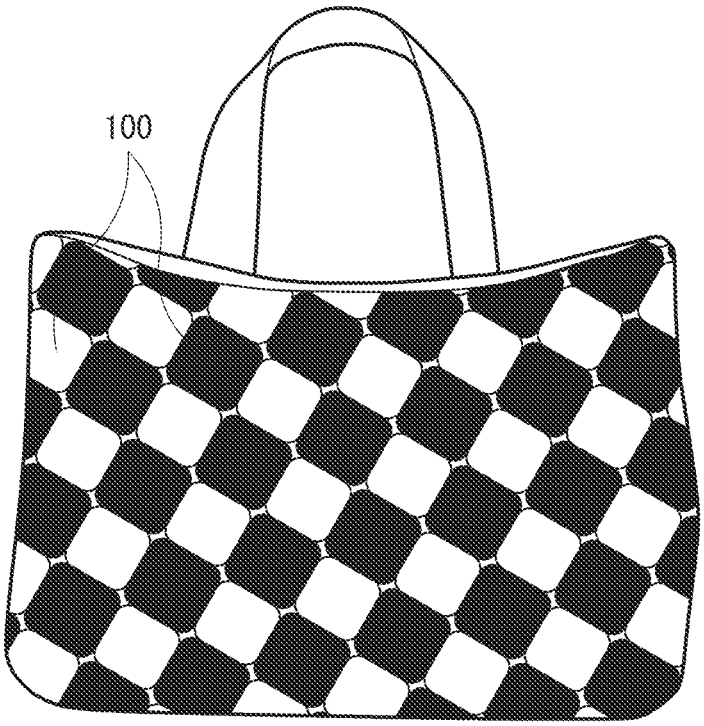

[ FIG. 19 ]
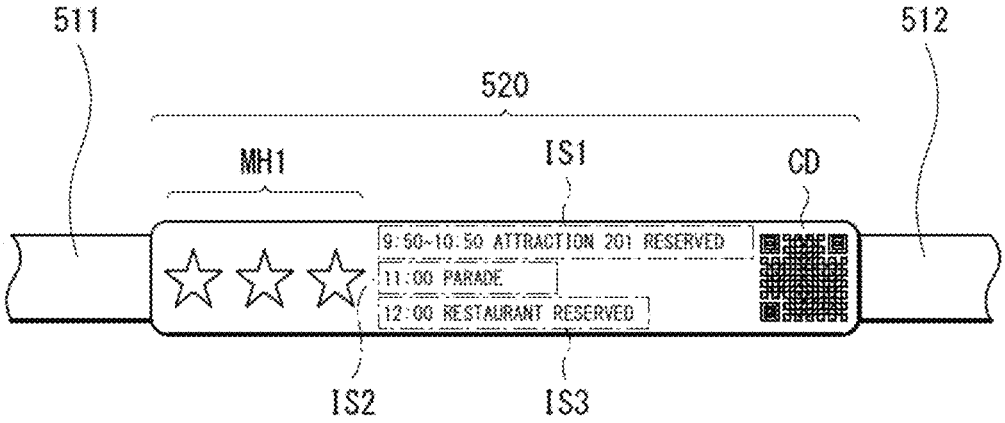

[ FIG. 20A ]
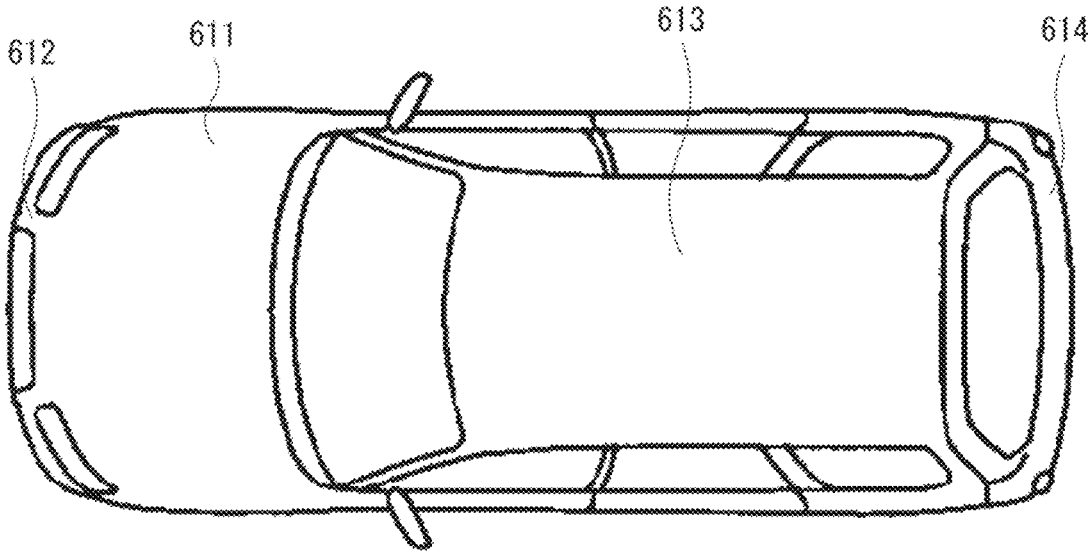
[ FIG. 20B ]
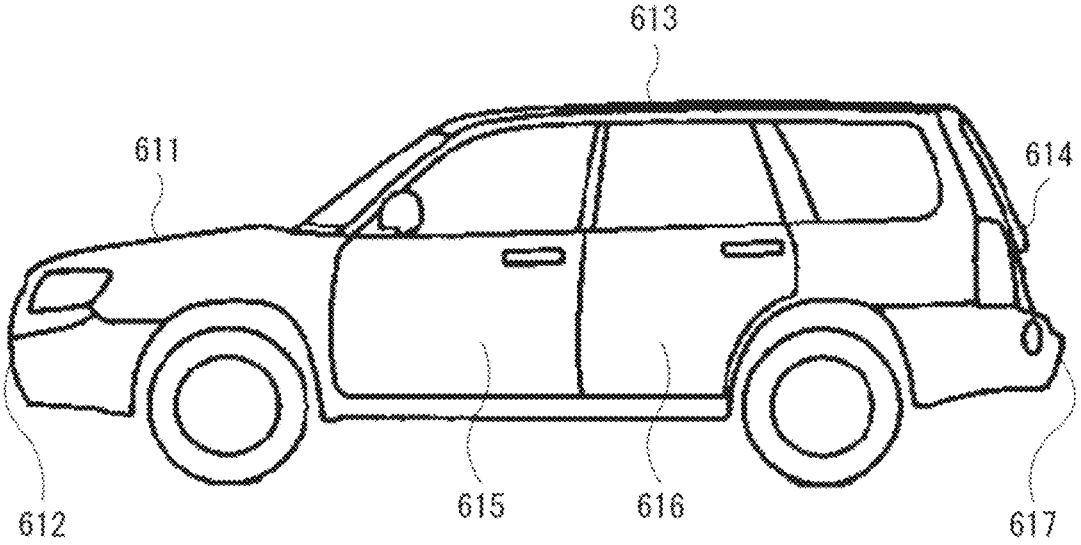

DRAWING METHOD, HEAT-SENSITIVE RECORDING MEDIUM, AND DRAWING DEVICE

TECHNICAL FIELD

The present disclosure relates to: a drawing method to be performed on a heat-sensitive recording medium containing, for example, a leuco dye; a heat-sensitive recording medium on which drawing is performed using the drawing method; and a drawing device.

BACKGROUND ART

A heat-sensitive recording medium has recently been developed which includes a recording layer containing a heat-sensitive color developing composition and a photothermal conversion agent that absorbs infrared wavelength light. As an example, there has been proposed a heat-sensitive recording medium in which a plurality of recording layers respectively including photothermal conversion agents that absorb infrared rays of different wavelengths is included, and, by applying infrared laser light that matches an absorption wavelength of a photothermal conversion agent, the corresponding photothermal conversion agent absorbs the laser light to cause a recording layer including the photothermal conversion agent to develop a color. However, in a case where recording is performed on the above-described heat-sensitive recording medium, there is an issue in that hue deviation from an assumed image occurs due to variations in a recording device, deviations from a design of the heat-sensitive recording medium, and the like, and display quality is lowered.

In contrast, for example, PTLs 1 and 2 each disclose an image forming apparatus in which a measurement section is provided in the apparatus, an image for gradation correction is outputted, image correction data is acquired from the image, and an image is written into a heat-sensitive recording medium on the basis of the image correction data.

CITATION LIST

Patent Literature

PTL 1: Japanese Unexamined Patent Application Publication No. 2009-302669

PTL 2: Japanese Unexamined Patent Application Publication No. 2014-150515

SUMMARY OF THE INVENTION

Thus, in a heat-sensitive recording medium, an improvement in display quality is desired.

It is desirable to provide a drawing method, a heat-sensitive recording medium, and a drawing device, which are able to improve display quality.

A drawing method according to an embodiment of the present disclosure to be performed on a heat-sensitive recording medium including a recording layer, the recording layer containing a leuco dye and a photothermal conversion agent that absorbs infrared wavelength light, includes: performing drawing in a plurality of first regions, the plurality of first regions each extending in one direction and having gaps therebetween; and thereafter detecting recorded states of the plurality of first regions, calculating differences from the input image information, and performing drawing in a plurality of second regions at recording intensities determined on a basis of the differences, the plurality of second regions each extending in the one direction and being provided at the gaps between the plurality of first regions.

A heat-sensitive recording medium according to an embodiment of the present disclosure includes a recording layer containing a leuco dye and a photothermal conversion agent that absorbs infrared wavelength light. The recording layer includes a plurality of first regions each extending in one direction and having gaps therebetween, and a plurality of second regions each extending in the one direction and being provided at the gaps between the plurality of first regions. A first color difference between the first region and the second region that are adjacent to each other on a straight line in another direction perpendicular to the one direction is larger than a second color difference between the plurality of first regions that are adjacent to each other on the straight line in the other direction.

A drawing device according to an embodiment of the present disclosure includes: a light source section that emits a light beam; a scanner section that performs drawing, on a recording layer containing a leuco dye and a photothermal conversion agent that absorbs infrared wavelength light to generate heat, by scanning the light beam emitted from the light source section in a plurality of first regions and a plurality of second regions, the plurality of first regions each extending in one direction and having gaps therebetween, the plurality of second regions each extending in the one direction and being provided at the gaps between the plurality of first regions; a detector that detects a recorded state of the recording layer; and a corrector that determines a recording intensity on a basis of a result obtained by the detector. The scanner section performs scanning in the plurality of first regions on a basis of input image information, the detector detects recorded states of the plurality of first regions in which drawing has been performed by the scanner section, and outputs, as image information of the plurality of first regions, the recorded states of the plurality of first regions to the corrector, the corrector calculates differences between the image information of the plurality of first regions inputted from the detector and the input image information, and determines, on a basis of the differences, recording intensities of drawing on the plurality of second regions, and the scanner section performs scanning in the plurality of second regions using the recording intensities determined by the corrector.

According to the drawing method of an embodiment of the present disclosure, the heat-sensitive recording medium of an embodiment of the present disclosure, and the drawing device of an embodiment of the present disclosure, the following is performed on the heat-sensitive recording medium including the recording layer containing the leuco dye and the photothermal conversion agent that absorbs infrared wavelength light to generate heat: performing drawing, on the basis of input image information, in the plurality of first regions each extending in the one direction and having gaps therebetween; and thereafter detecting the recorded states of the plurality of first regions, calculating the differences from the input image information, and performing drawing in the plurality of second regions at the recording intensities determined on the basis of the differences, the plurality of second regions each extending in the one direction and being provided at the gaps between the plurality of first regions. This decreases hue deviation from the input image information due to variations in a recording device, deviations from a design of the heat-sensitive recording medium, and the like. On the recording layer, an image is drawn in which the first color difference between the first region and the second region that are adjacent to each other on the straight line in the other direction perpendicular to the one direction is larger than the second color difference between the first regions that are adjacent to each other on the straight line in the other direction.

BRIEF DESCRIPTION OF DRAWINGS

FIG. 1 is a flowchart of a drawing method to be performed on a heat-sensitive recording medium according to a first embodiment of the present disclosure.

FIG. 2 is a plan schematic view of the heat-sensitive recording medium according to the first embodiment of the present disclosure.

FIG. 5 is an example of an input image.

FIG. 6A is a diagram illustrating a drawn image of a recording layer in step S101 of the drawing method illustrated in FIG. 1.

FIG. 6B is a diagram illustrating a drawn image of a recording layer in step S104 of the drawing method illustrated in FIG. 1.

FIG. 7 is a diagram illustrating gradations of respective blocks of the input image illustrated in FIG. 5.

FIG. 8 is a characteristic diagram illustrating an example of variations in a laser intensity with respect to a main scanning direction.

FIG. 9 is a characteristic diagram illustrating an example of variations in a thickness of a recording layer with respect to the main scanning direction.

FIG. 10 is a diagram illustrating gradations of respective blocks in first regions drawn in step S101.

FIG. 11 is a diagram illustrating gradations of respective blocks in second regions drawn in step S104.

FIG. 12 is a characteristic diagram illustrating a relationship between: a laser intensity; and an assumed gradation and an actual gradation.

FIG. 13 is a flowchart of a drawing method to be performed on a heat-sensitive recording medium according to a second embodiment of the present disclosure.

FIG. 14A is a diagram illustrating gradations of respective blocks in first regions drawn in step S201.

FIG. 14B is a diagram illustrating an example of gradations of respective blocks in second regions drawn in step S204.

FIG. 14C is a diagram illustrating an example of gradations of respective blocks in third regions drawn in step S207.

FIG. 15A is a diagram illustrating gradations of the respective blocks in the first regions drawn in step S201.

FIG. 15B is a diagram illustrating another example of gradations of the respective blocks in the second regions drawn in step S204.

FIG. 15C is a diagram illustrating another example of gradations of the respective blocks in the third regions drawn in step S207.

FIG. 16A is a perspective view illustrating an example of an appearance of an application example 1.

FIG. 16B is a perspective view illustrating another example of the appearance of the application example 1.

FIG. 17A is a perspective view illustrating an example of an appearance (on a front side) of an application example 2.

FIG. 17B is a perspective view illustrating an example of an appearance (on a rear side) of the application example 2.

FIG. 18A is a perspective view illustrating an example of an appearance of an application example 3.

FIG. 18B is a perspective view illustrating another example of the appearance of the application example 3.

FIG. 19 is an explanatory diagram illustrating a configuration example of an application example 4.

FIG. 20A is a perspective view illustrating an example of an appearance (an upper surface) of an application example 5.

FIG. 20B is a perspective view illustrating an example of an appearance (a side surface) of the application example 5.

MODES FOR CARRYING OUT THE INVENTION

Figure 3:
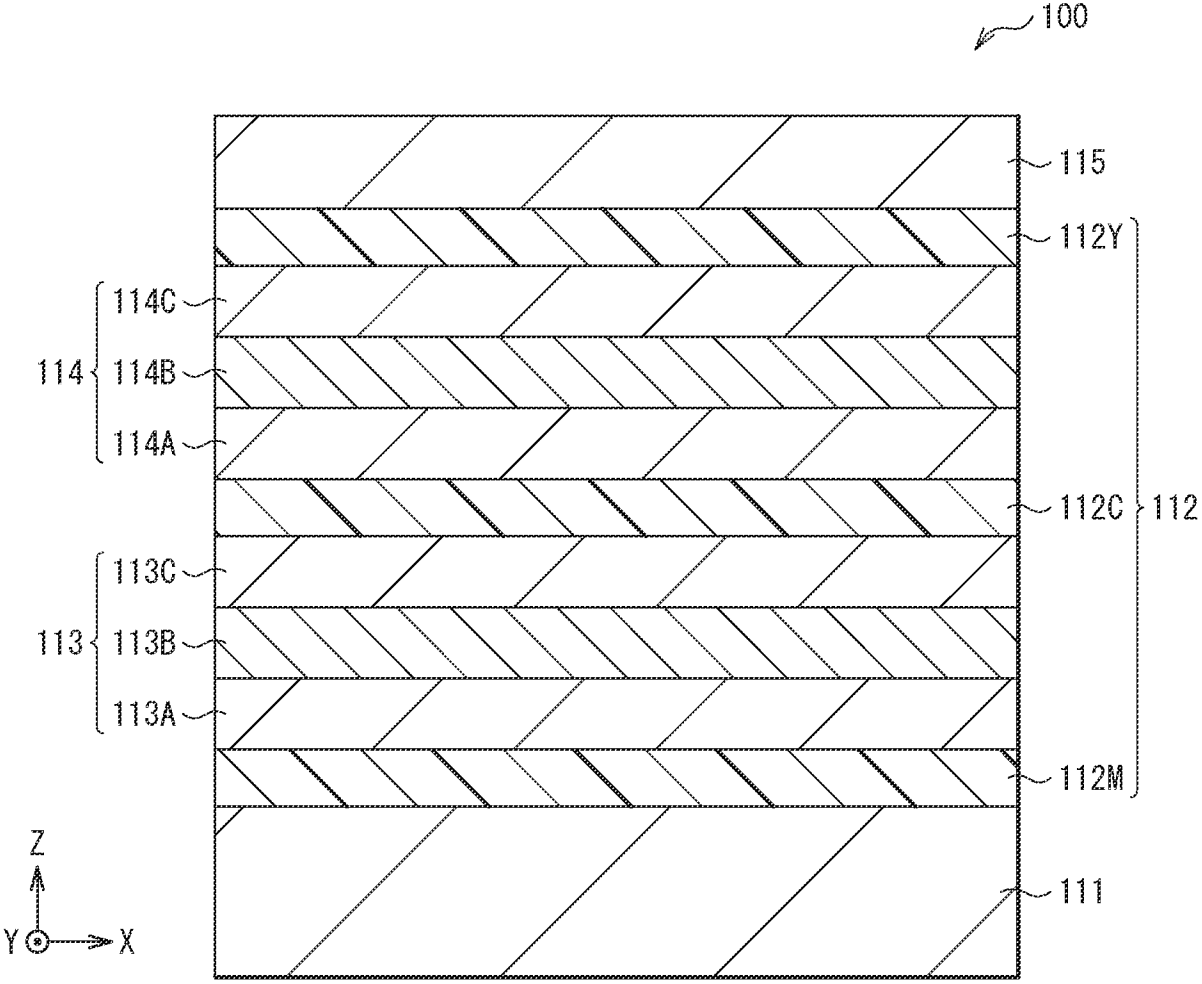
FIG. 3 is a cross-sectional schematic view of an example of a configuration of the heat-sensitive recording medium illustrated in FIG. 2.

In the following, some embodiments of the present disclosure are described in detail with reference to the drawings. The following description is directed to specific examples of the present disclosure, and the present disclosure is not limited to the following embodiments. In addition, the present disclosure is not limited to the arrangement, dimensions, dimensional ratios, and the like of the components illustrated in the drawings. It is to be noted that the description is given in the following order.

1. First Embodiment (An example of a drawing method including performing drawing in first regions, and then performing, at recording intensities that are determined on the basis of differences between the drawn image and an input image, drawing in second regions)
1-1. Configuration of Heat-Sensitive Recording Medium
1-2. Configuration of Drawing Device
1-3. Method of Drawing on Heat-Sensitive Recording Medium
1-4. Workings and Effects
2. Second Embodiment (An example in which two or more recording intensity corrections are performed)
3. Application Examples 1 to 5

1. First Embodiment

Figure 4:
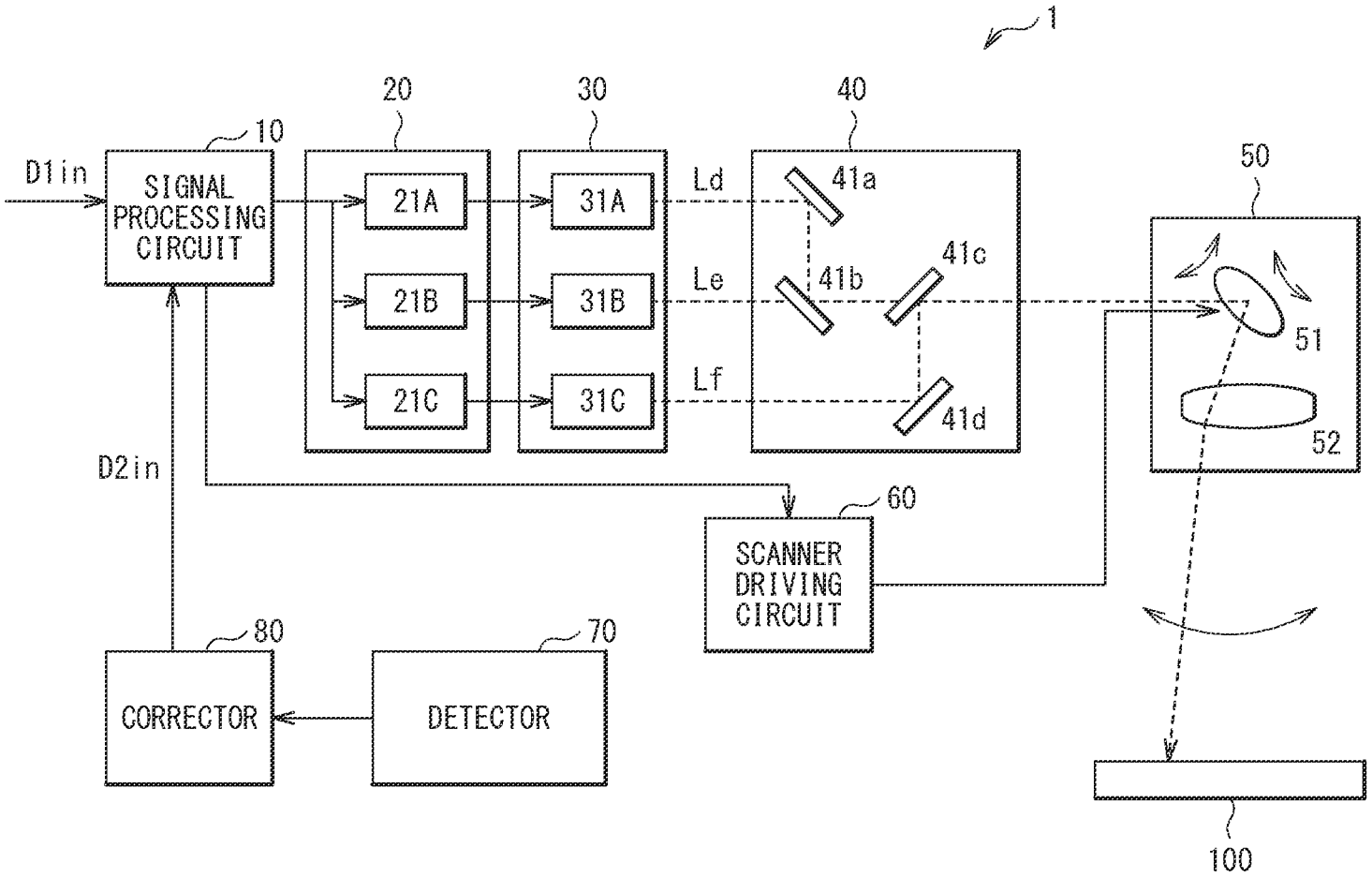
FIG. 4 is a diagram illustrating a system configuration example of a drawing device according to the first embodiment of the present disclosure.

A drawing method to be performed on a heat-sensitive recording medium according to a first embodiment of the present disclosure will be described. FIG. 1 illustrates a flow of the drawing method according to the present embodiment. FIG. 2 is a plan schematic view of the heat-sensitive recording medium (a heat-sensitive recording medium 100) on which drawing is performed using the drawing method illustrated in FIG. 1. FIG. 3 schematically illustrates an example of a cross-sectional configuration of the heat-sensitive recording medium 100 illustrated in FIG. 2. FIG. 4 illustrates an example of a system configuration of a drawing device (a drawing device 1) according to the present embodiment. It is to be noted that the heat-sensitive recording medium 100 illustrated in FIG. 3 is a schematic representation of a cross-sectional configuration, and may have a size and a shape that are different an actual size and an actual shape.

The drawing method according to the present embodiment includes, on the heat-sensitive recording medium 100: performing drawing in a plurality of first regions A1, A2, . . . , and An on the basis of input image information, the plurality of first regions A1, A2, . . . , and An each extending in one direction (e.g., in an X-axis direction) and having gaps therebetween; and thereafter detecting recorded states of the first regions A1, A2, . . . , and An, calculating differences from the input image information, and performing drawing in a plurality of second regions B1, B2, . . . , Bn at recording intensities determined on the basis of the differences, the plurality of second regions B1, B2, . . . , Bn being provided at the gaps between the first regions A1, A2, . . . , and An and each extending in the one direction. This forms a drawn image on the heat-sensitive recording medium 100. The drawn image has a color difference (ΔEa1−b2; a first color difference) between a1 of the first region A1 and b1 of the second region B1, for example, that are adjacent to each other on a straight line in another direction (e.g., a Y-axis direction) perpendicular to the X-axis direction is larger than a color difference (ΔEa1−a2; a second color difference) between a1 of the first region A1 and a2 of the first region A2, for example, that are adjacent to each other on the straight line in the Y-axis direction.

First, the heat-sensitive recording medium 100 and the drawing device 1 will be described, and then the drawing method to be performed on the heat-sensitive recording medium 100 using the same will be described.

(1-1. Configuration of Heat-Sensitive Recording Medium)

The heat-sensitive recording medium 100 is a reversible recording medium that enables information to be recorded and deleted reversibly by heat, and, for example, a recording layer 112 that is able to reversibly change a recorded state and a deleted state is disposed on a support base 11. The recording layer 112 has, for example, a configuration in which three layers having developed color tones different from each other (a recording layer 112M, a recording layer 112C, and a recording layer 112Y) are stacked in this order. Intermediate layers 113 and 114 each including a plurality of layers (here, three layers) are provided between the recording layer 112M and the recording layer 112C and between the recording layer 112C and the recording layer 112Y, respectively. A protective layer 15 is provided on the recording layer 112Y.

The support base 111 serves to support the recording layer 112. The support base 111 is configured by a material having superior heat resistance as well as superior size stability in a planar direction. The support base 111 may have a property of either light-transmissivity or non-light transmissivity. For example, the support base 111 either may be a substrate having rigidity, such as a wafer, or may be configured by flexible thin layer glass, film, paper, or the like. The use of a flexible substrate as the support base 111 allows for achievement of a flexible (foldable) reversible recording medium.

Examples of a constituent material of the support base 111 include an inorganic material, a metal material, and a macromolecular material such as plastic. Specific examples of the inorganic material include silicon (Si), silicon oxide (SiOx), silicon nitride (SiNx), aluminum oxide (AlOx), and magnesium oxide (MgOx). Examples of silicon oxide include glass and spin-on-glass (SOG). Examples of the metal material include metal element such as aluminum (Al), copper (Cu), silver (Ag), gold (Au), platinum (Pt), palladium (Pd), nickel (Ni), tin (Sn), cobalt (Co), rhodium (Rh), iridium (Ir), iron (Fe), ruthenium (Ru), osmium (Os), manganese (Mn), molybdenum (Mo), tungsten (W), niobium (Nb), tantalum (Ta), titanium (Ti), bismuth (Bi), antimony (Sb), or lead (Pb), or an alloy containing two or more of those. Specific examples of the alloy include stainless steel (SUS), an aluminum alloy, a magnesium alloy, a titanium alloy, and the like. Examples of the macromolecular material include a phenol resin, an epoxy resin, a melamine resin, an unsaturated polyester resin, a urethane resin, polyimide, polyethylene, high-density polyethylene, medium-density polyethylene, low-density polyethylene, polypropylene, polyvinyl chloride, polyvinylidene chloride, polystyrene, polyvinyl acetate, polyurethane, an acrylonitrile butadiene styrene resin (ABS), an acrylic resin (PMMA), polyamide, nylon, polyacetal, polycarbonate (PC), denatured polyphenylene ether, polyethylene terephthalate (PET), polybutylene terephthalate, cyclic polyolefin, polyphenylene sulfide, polytetrafluoroethylene (PTFE), polysulfone, polyethersulfone, non-crystalline polyarylate, liquid crystal polymer, polyether ether ketone (PEEK), polyamide imide, polyethylene naphthalate (PEN), and triacetyl cellulose, cellulose, or a copolymer thereof, glass-fiber reinforced plastic, carbon-fiber reinforced plastic (CFRP), and the like. It is to be noted that an upper surface or a lower surface of the support base 111 may be provided with a reflective layer. The provision of the reflective layer allows for more vivid color display.

The recording layer 112 enables information to be written and deleted reversibly by heat, and is configured by a material that allows for stable repeated recording and allows for control of a decolored state and a color-developed state. The recording layer 112 includes, for example, the recording layer 112M to be colored in a magenta color (M), the recording layer 112C to be colored in a cyan color (C), and the recording layer 112Y to be colored in a yellow color (Y).

The recording layer 112, the recording layers 112M, 112C, and 112Y include, for example, macromolecular materials that include coloring compounds to be colored in different colors (reversible heat-sensitive color developing compositions), color developing/quenching agents corresponding to the respective coloring compounds, and photothermal conversion agents that absorb light rays of different wavelength regions to generate heat. This allows heat-sensitive recording medium 100 to color multi-color display. Specifically, the recording layer 112M includes, for example, a coloring compound to be colored in a magenta color, a color developing/quenching agent corresponding to the coloring compound, and a photothermal conversion agent that absorbs an infrared ray of a light emission wavelength λ1, for example, to generate heat. The recording layer 112C includes, for example, a coloring compound that develops a cyan color, a color developing/quenching agent corresponding to the coloring compound, and a photothermal conversion agent that absorbs an infrared ray of a light emission wavelength λ2, for example, to be colored. The recording layer 112Y includes, for example, a coloring compound to be colored in a yellow color, a color developing/quenching agent corresponding to the coloring compound, and a photothermal conversion agent that absorbs an infrared ray of a light emission wavelength λ3, for example, to generate heat. The light emission wavelengths λ1, λ2, and λ3 differ from each other.

It is to be noted that the recording layers 112M, 112C, and 112Y each become transparent in a decolored state. This enables the, heat-sensitive recording medium 100 to perform recording in a wide color gamut. A thickness in a stacking direction (hereinafter, simply referred to as thickness) of each of the recording layers 112M, 112C, and 112Y is more than or equal to 1 μm and less than or equal to 10 μm, for example.

Examples of the coloring compound include a leuco pigment. Examples of the leuco pigment include existing pigment for heat-sensitive paper. A specific example thereof includes a compound that contains, in a molecule, a group having an electron-donating property and is represented by the following formula (1).

[Chem. 1]

(1)

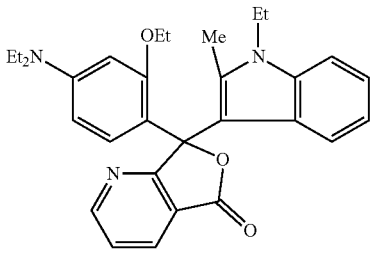

The coloring compounds used for the recording layers 112M, 112C, and 112Y are not particularly limited, and it is possible to be appropriately selected according to the purposes. Specific examples of the coloring compound include, in addition to the compound shown in the above formula (1), a fluoran-based compound, a triphenylmethane phthalide-based compound, an azaphthalide-based compound, a phenothiazine-based compound, a leuco auramine-based compound, an indolinophthalide-based compound, and the like. Other examples include 2-anilino-3-methyl-6-diethylaminofluoran, 2-anilino-3-methyl-6-di(n-butylamino)fluoran, 2-anilino-3-methyl-6-(N-n-propyl-N-methylamino)fluoran, 2-anilino-3-methyl-6-(N-isopropyl-N-methylamino)fluoran, 2-anilino-3-methyl-6-(N-isobutyl-N-methylamino)fluoran, 2-anilino-3-methyl-6-(N-n-amyl-N-methylamino)fluoran, 2-anilino-3-methyl-6-(N-sec-butyl-N-methylamino)fluoran, 2-anilino-3-methyl-6-(N-n-amyl-N-ethylamino)fluoran, 2-anilino-3-methyl-6-(N-iso-amyl-N-ethylamino)fluoran, 2-anilino-3-methyl-6-(N-n-propyl-N-isopropylamino)fluoran, 2-anilino-3-methyl-6-(N-cyclohexyl-N-methylamino)fluoran, 2-anilino-3-methyl-6-(N-ethyl-p-toluidino)fluoran, 2-anilino-3-methyl-6-(N-methyl-p-toluidino)fluoran, 2-(m-trichloromethylanilino)-3-methyl-6-diethylaminofluoran, 2-(m-trifluoromethylanilino)-3-methyl-6-diethylaminofluoran, 2-(m-trichloromethylanilino)-3-methyl-6-(N-cyclohexyl-N-methylamino)fluoran, 2-(2,4-dimethylanilino)-3-methyl-6-diethylaminofluoran, 2-(N-ethyl-p-toluidino)-3-methyl-6-(N-ethylanilino)fluoran, 2-(N-ethyl-p-toluidino)-3-methyl-6-(N-propyl-p-toluidino)fluoran, 2-anilino-6-(N-n-hexyl-N-ethylamino)fluoran, 2-(o-chloroanilino)-6-diethylaminofluoran, 2-(o-chloroanilino)-6-dibutylaminofluoran, 2-(m-trifluoromethylanilino)-6-diethylaminofluoran, 2,3-dimethyl-6-dimethylaminofluoran, 3-methyl-6-(N-ethyl-p-toluidino)fluoran, 2-chloro-6-diethylaminofluoran, 2-bromo-6-diethylaminofluoran, 2-chloro-6-dipropylaminofluoran, 3-chloro-6-cyclohexylaminofluoran, 3-bromo-6-cyclohexylaminofluoran, 2-chloro-6-(N-ethyl-N-isoamylamino)fluoran, 2-chloro-3-methyl-6-diethylaminofluoran, 2-anilino-3-chloro-6-diethylaminofluoran, 2-(o-chloroanilino)-3-chloro-6-cyclohexylaminofluoran, 2-(m-trifluoromethylanilino)-3-chloro-6-diethylaminofluoran, 2-(2,3-dichloroanilino)-3-chloro-6-diethylaminofluoran, 1,2-benzo-6-diethylaminofluoran, 3-diethylamino-6-(m-trifluoromethylanilino)fluoran, 3-(1-ethyl-2-methylindole-3-yl)-3-(2-ethoxy-4-diethylaminophenyl)-4-azaphthalide, 3-(1-ethyl-2-methylindole-3-yl)-3-(2-ethoxy-4-diethylaminophenyl)-7-azaphthalide, 3-(1-octyl-2-methylindole-3-yl)-3-(2-ethoxy-4-diethylaminophenyl)-4-azaphthalide, 3-(1-ethyl-2-methylindole-3-yl)-3-(2-methyl-4-diethylaminophenyl)-4-azaphthalide, 3-(1-ethyl-2-methylindole-3-yl)-3-(2-methyl-4-diethylaminophenyl)-7-azaphthalide, 3-(1-ethyl-2-methylindole-3-yl)-3-(4-diethylaminophenyl)-4-azaphthalide, 3-(1-ethyl-2-methylindole-3-yl)-3-(4-N-n-amyl-N-methylaminophenyl)-4-azaphthalide, 3-(1-methyl-2-methylindole-3-yl)-3-(2-hexyloxy-4-diethylaminophenyl)-4-azaphthalide, 3,3-bis(2-ethoxy-4-diethylaminophenyl)-4-azaphthalide, 3,3-bis(2-ethoxy-4-diethylaminophenyl)-7-azaphthalide, 2-(p-acetylanilino)-6-(N-n-amyl-N-n-butylamino)fluoran, 2-benzylamino-6-(N-ethyl-p-toluidino)fluoran, 2-benzylamino-6-(N-methyl-2,4-dimethylanilino)fluoran, 2-benzylamino-6-(N-ethyl-2,4-dimethylanilino)fluoran, 2-benzylamino-6-(N-methyl-p-toluidino)fluoran, 2-benzylamino-6-(N-ethyl-p-toluidino)fluoran, 2-(di-p-methylbenzylamino)-6-(N-ethyl-p-toluidino)fluoran, 2-(α-phenylethylamino)-6-(N-ethyl-p-toluidino)fluoran, 2-methylamino-6-(N-methylanilino)fluoran, 2-methylamino-6-(N-ethylanilino)fluoran, 2-methylamino-6-(N-propylanilino)fluoran, 2-ethylamino-6-(N-methyl-p-toluidino)fluoran, 2-methylamino-6-(N-methyl-2,4-dimethylanilino)fluoran, 2-ethylamino-6-(N-ethyl-2,4-dimethylanilino)fluoran, 2-dimethylamino-6-(N-methylanilino)fluoran, 2-dimethylamino-6-(N-ethylanilino)fluoran, 2-diethylamino-6-(N-methyl-p-toluidino)fluoran, 2-diethylamino-6-(N-ethyl-p-toluidino)fluoran, 2-dipropylamino-6-(N-methylanilino)fluoran, 2-dipropylamino-6-(N-ethylanilino)fluoran, 2-amino-6-(N-methylanilino)fluoran, 2-amino-6-(N-ethylanilino)fluoran, 2-amino-6-(N-propylanilino)fluoran, 2-amino-6-(N-methyl-p-toluidino)fluoran, 2-amino-6-(N-ethyl-p-toluidino)fluoran, 2-amino-6-(N-propyl-p-toluidino)fluoran, 2-amino-6-(N-methyl-p-ethylanilino)fluoran, 2-amino-6-(N-ethyl-p-ethylanilino)fluoran, 2-amino-6-(N-propyl-p-ethylanilino)fluoran, 2-amino-6-(N-methyl-2,4-dimethylanilino)fluoran, 2-amino-6-(N-ethyl-2,4-dimethylanilino)fluoran, 2-amino-6-(N-propyl-2,4-dimethylanilino)fluoran, 2-amino-6-(N-methyl-p-chloroanilino)fluoran, 2-amino-6-(N-ethyl-p-chloroanilino)fluoran, 2-amino-6-(N-propyl-p-chloroanilino)fluoran, 1,2-benzo-6-(N-ethyl-N-isoamylamino)fluoran, 1,2-benzo-6-dibutylaminofluoran, 1,2-benzo-6-(N-methyl-N-cyclohexylamino)fluoran, 1,2-benzo-6-(N-ethyl-N-toluidino)fluoran, and the like. For the recording layers 112M, 112C, and 112Y, one kind of the above coloring compounds may be used alone, or two or more kinds may be used in combination.

The color developing/quenching agent serves, for example, to develop a color of a colorless coloring compound or to decolor a coloring compound colored in a predetermined color. Examples of the color developing/quenching agent include a phenol derivative, a salicylic acid derivative, and a urea derivative. Specific examples thereof include a compound having a salicylic acid skeleton represented by the following general formula (2) and containing, in a molecule, a group having an electron-accepting property.

[Chem. 2]

(2)

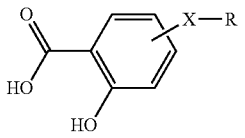

(X is one of —NHCO—, —CONH—, —NHCONH—, —CONHCO—, —NHNHCO—, —CONHNH—, —CONHNHCO—, —NHCOCONH—, —NHCONHCO—, —CONHCONH—, —NHNHCONH—, —NHCONHNH—, —CONHNHCONH—, —NHCONHNHCO—, and —CONHNHCONH—. R is a linear hydrocarbon group having 25 to 34 carbon atoms.)

Other examples of the color developing/quenching agent include 4,4'-isopropylidenebisphenol, 4,4'-isopropylidenebis(o-methylphenol), 4,4'-secondary butylidenebisphenol, 4,4'-isopropylidenebis(2-tertiary butylphenol), zinc p-nitrobenzoate, 1,3,5-tris(4-tertiary butyl-3-hydroxy-2,6-dimethylbenzyl)isocyanuric acid, 2,2-(3,4'-dihydroxydiphenyl) propane, bis(4-hydroxy-3-methylphenyl)sulfide, 4-{β-(p-methoxyphenoxy)ethoxy}salicylic acid, 1,7-bis(4-hydroxyphenylthio)-3,5-dioxaheptane, 1,5-bis(4-hydroxyphenylthio)-5-oxapentane, phthalic acid monobenzyl ester monocalcium salt, 4,4'-cyclohexylidenediphenol, 4,4'-isopropylidenebis(2-chlorophenol), 2,2'-methylenebis(4-methyl-6-tertiary-butylphenol), 4,4'-butylidenebis(6-tertiary-butyl-2-methyl)phenol, 1,1,3-tris(2-methyl-4-hydroxy-5-tertiary-butylphenyl)butane, 1,1,3-tris (2-methyl-4-hydroxy-5-cyclohexylphenyl)butane, 4,4'-thiobis(6-tertiary-butyl-2-methyl)phenol, 4,4'-diphenolsulfone, 4-isopropoxy-4'-hydroxydiphenylsulfone (4-hydroxy-4'-isopropoxydiphenylsulfone), 4-benzyloxy-4'-hydroxydiphenylsulfone, 4,4'-diphenolsulfoxide, isopropyl p-hydroxybenzoate, benzyl p-hydroxybenzoate, benzyl protocatechuate, stearyl gallate, lauryl gallate, octyl gallate, 1,3-bis(4-hydroxyphenylthio)-propane, N,N'-diphenylthiourea, N,N'-di(m-chlorophenyl)thiourea, salicylanilide, bis (4-hydroxyphenyl)methyl acetate, bis(4-hydroxyphenyl) benzyl acetate, 1,3-bis(4-hydroxycumyl)benzene, 1,4-bis(4-hydroxycumyl)benzene, 2,4'-diphenolsulfone, 2,2'-diallyl-4, 4'-diphenolsulfone, 3,4-dihydroxyphenyl-4'-methyldiphenylsulfone, zinc 1-acetyloxy-2-naphthoate, zinc 2-acetyloxy-1-naphthoate, zinc 2-acetyloxy-3-naphthoate, α,α-bis(4-hydroxyphenyl)-α-methyltoluene, an antipyrine complex of zinc thiocyanate, tetrabromobisphenol A, tetrabromobisphenol S, 4,4'-thiobis(2-methylphenol), 4,4'-thiobis(2-chlorophenol), dodecylphosphonic acid, tetradecylphosphonic acid, hexadecylphosphonic acid, octadecylphosphonic acid, eicosylphosphonic acid, docosylphosphonic acid, tetracosylphosphonic acid, hexacosylphosphonic acid, octacosylphosphonic acid, α-hydroxydodecylphosphonic acid, α-hydroxytetradecylphosphonic acid, α-hydroxyhexadecylphosphonic acid, α-hydroxyoctadecylphosphonic acid, α-hydroxyeicosylphosphonic acid, α-hydroxydocosylphosphonic acid, α-hydroxytetracosylphosphonic acid, dihexadecyl phosphate, dioctadecyl phosphate, dieicosyl phosphate, didocosyl phosphate, monohexadecyl phosphate, monooctadecyl phosphate, monoeicosyl phosphate, monodocosyl phosphate, methylhexadecyl phosphate, methyloctadecyl phosphate, methyleicosyl phosphate, methyldocosyl phosphate, amylhexadecyl phosphate, octylhexadecyl phosphate, laurylhexadecyl phosphate, and the like. For the recording layers 112M, 112C, and 112Y, one kind of the above color developing/quenching agents may be used alone, or two or more kinds may be used in combination.

The photothermal conversion agent serves, for example, to absorb light in a wavelength region of a property of a near infrared region (e.g., a wavelength of more than or equal to 700 nm and less than or equal to 2500 nm) to generate heat. In the present embodiment, it is preferable to select, for the photothermal conversion agents to be used for the recording layers 112M, 112C, and 112Y, a combination of materials having narrow photoabsorption bands that do not overlap one another. This makes it possible to selectively color or decolor a desired layer of the recording layers 112M, 112C, and 112Y. Example of the photothermal conversion agent included in the recording layer 112M includes a photothermal conversion agent that has an absorption peak in a wavelength of 760 nm. Example of the photothermal conversion agent included in the recording layer 112C includes a photothermal conversion agent that has an absorption peak in a wavelength of 860 nm. Example of the photothermal conversion agent included in the recording layer 112Y includes a photothermal conversion agent that has an absorption peak in a wavelength of 915 nm. It is to be noted that the above absorption peaks are examples, and are not limited thereto.

Examples of the photothermal conversion agent include a compound having a phthalocyanine skeleton (a phthalocyanine-based pigment), a compound having a naphthalocyanine skeleton (a naphthalocyanine-based pigment), a compound having a squarylium skeleton (a squarylium-based pigment), a compound having a cyanine skeleton (a cyanine-based pigment), an organic compound such as a diimonium salt, or an aminium salt, a metal complex such as a dithio complex, an inorganic compound such as cobalt tetraoxide, iron oxide, chromium oxide, copper oxide, titanium black, ITO, niobium nitride, and an organometallic compound such as tantalum carbide.

As the macromolecular material, it is preferable to adopt a material in which the coloring compound, the color developing/quenching agent, and the photothermal conversion agent are easily dispersed evenly. As the macromolecular material, for example, a matrix resin is preferably used; examples thereof include a thermosetting resin and a thermoplastic resin. Specific examples thereof include polyvinyl chloride, polyvinyl acetate, a vinyl chloride-vinyl acetate copolymer, ethyl cellulose, polystyrene, a styrene-based copolymer, a phenoxy resin, polyester, aromatic polyester, polyurethane, polycarbonate, a polyacrylic ester, a polymethacrylic ester, an acrylic-based copolymer, a maleic acid-based polymer, a cycloolefin copolymer, polyvinylalcohol, modified polyvinylalcohol, polyvinylbutyral, polyvinylphenol, polyvinylpyrrolidone, hydroxyethyl cellulose, carboxymethyl cellulose, starch, a phenol resin, an epoxy resin, a melamine resin, a urea resin, an unsaturated polyester resin, an alkyd resin, a urethane resin, a polyarylate resin, polyimide, polyamide, and polyamide-imide. The above macromolecular materials may be crosslinked and used.

The recording layers 112M, 112C, and 112Y each include at least one of the coloring compounds, at least one of the color developing/quenching agents, and at least one of the photothermal conversion agents. The recording layers 112M, 112C, and 112Y may each include, in addition to the above-mentioned materials, various additives such as a sensitizer and an ultraviolet absorbing agent, for example.

The intermediate layers 113 and 114 serve to suppress diffusion of contained molecules and occurrence of heat transfer at the time of drawing, between the recording layer 112M and the recording layer 112C and between the recording layer 112C and the recording layer 112Y. The intermediate layer 113 has, for example, a three-layer configuration in which a first layer 113A, a second layer 113B, and a third layer 113C are stacked in this order. The intermediate layer 114 has, similarly to the intermediate layer 113, a three-layer configuration in which a first layer 114A, a second layer 114B, and a third layer 114C are stacked in this order. Each of the layers 113A, 113B, and 113C (, 114A, 114B, and 114C) is formed using a typical macromolecular material having translucency, and in particular, it is preferable that the middle layers (the second layers 113B and 114B) in the above-mentioned multilayer structure be each formed using a material having a lower Young's modulus than the other layers (the first layers 113A and 114A and the third layers 113C and 114C), for example.

The first layers 113A and 114A and the third layers 113C and 114C are each configured, for example, using a typical macromolecular material having translucency. Specific examples of the material include polyvinyl chloride, polyvinyl acetate, a vinyl chloride-vinyl acetate copolymer, ethyl cellulose, polystyrene, a styrene-based copolymer, a phenoxy resin, polyester, aromatic polyester, polyurethane, polycarbonate, a polyacrylic ester, a polymethacrylic ester, an acrylic-based copolymer, a maleic acid-based polymer, a cycloolefin copolymer, polyvinylalcohol, modified polyvinylalcohol, polyvinylbutyral, polyvinylphenol, polyvinylpyrrolidone, hydroxyethyl cellulose, carboxymethyl cellulose, starch, a phenol resin, an epoxy resin, a melamine resin, a urea resin, an unsaturated polyester resin, an alkyd resin, a urethane resin, a polyarylate resin, polyimide, polyamide, and polyamide-imide.

Examples of the material of the second layers 113B and 114B include a silicone-based elastomer, an acrylic elastomer, a urethane-based elastomer, a styrene-based elastomer, a polyester-based elastomer, an olefin-based elastomer, a polyvinyl chloride-based elastomer, a natural rubber, a styrene-butadiene rubber, an isoprene rubber, a butadiene rubber, a chloroprene rubber, an acrylonitrile-butadiene rubber, a butyl rubber, an ethylene-propylene rubber, an ethylene-propylene-diene rubber, a urethane rubber, a silicone rubber, a fluorine rubber, chlorosulfonated polyethylene, chlorinated polyethylene, an acrylic rubber, a polysulfide rubber, an epichlorohydrin rubber, polydimethylsiloxane (PDMS), polyvinyl chloride, polyvinyl acetate, a vinyl chloride-vinyl acetate copolymer, ethyl cellulose, polystyrene, a styrene-based copolymer, a phenoxy resin, polyester, aromatic polyester, polyurethane, polycarbonate, a polyacrylic ester, a polymethacrylic ester, an acrylic-based copolymer, a maleic acid-based polymer, a cycloolefin copolymer, polyvinylalcohol, modified polyvinylalcohol, polyvinylbutyral, polyvinylphenol, polyvinylpyrrolidone, hydroxyethyl cellulose, carboxymethyl cellulose, starch, a phenol resin, an epoxy resin, a melamine resin, a urea resin, an unsaturated polyester resin, an alkyd resin, a urethane resin, a polyarylate resin, polyimide, polyamide, and polyamide-imide.

Combinations of materials included in the layers 113A, 113B, and 113C (, 114A, 114B, and 114C) are not limited as long as the materials of the second layers 113B and 114B each have a lower Young's modulus than the materials of the first layers 113A and 114A and the third layers 113C and 114C. Further, for the intermediate layers 113 and 114, the above macromolecular materials may be crosslinked and used. In addition, the intermediate layers 113 and 24 may include various additive such as an ultraviolet absorbing agent, for example.

A thickness of each of the intermediate layers 113 and 114 is preferably more than or equal to 1 μm and less than or equal to 100 μm, for example, and more preferably more than or equal to 5 μm and less than or equal to 20 μm, for example. Among those, a thickness of each of the first layers 113A and 114A is preferably more than or equal to 0.1 μm and less than or equal to 10 μm or less, for example, and a thickness of each of the second layers 113B and 114B is preferably more than or equal to 0.01 μm and less than or equal to 10 μm, for example. A thickness of each of the third layers 113C and 114C is preferably more than or equal to 0.1 μm and less than or equal to 10 μm, for example.

The protective layer 115 serves to protect a surface of the recording layer 112 (here, the recording layer 112Y), and is formed using an ultraviolet curable resin or a thermosetting resin, for example. The protective layer 115 has a thickness of more than or equal to 0.1 μm and less than or equal to 100 μm, for example.

(1-2. Configuration of Drawing Device)

Next, the drawing device 1 according to the present embodiment will be described.

The drawing device 1 includes, for example, a signal processing circuit 10, a laser driving circuit 20, a light source section 30, a multiplexer 40, a scanner section 50, a scanner driving circuit 60, a detector 70, and a corrector 80.

The signal processing circuit 10 converts a drawing signal D1*in* inputted from the outside and a drawing signal D2*in* inputted from a corrector 8080 to be described later into an image signal corresponding to a wavelength of each light source of the light source section 30 (color gamut conversion) depending on a characteristic of the heat-sensitive recording medium 100 and a condition written in the heat-sensitive recording medium 100. The signal processing circuit 10 generates, for example, a projection image clock signal that is synchronized with a scanner operation of the scanner section 50. The signal processing circuit 10 generates, for example, a projection image signal such that a light beam (a laser light beam) is outputted in accordance with the generated image signal. The signal processing circuit 10 outputs the generated projection image signal to the laser driving circuit 20, for example. Further, the signal processing circuit 10 outputs the projection image clock signal to the laser driving circuit 20 as necessary, for example.

The laser driving circuit 20 drives each of light sources 31A, 31B, and 31C of the light source section 30 in accordance with the projection image signal corresponding to each wavelength, for example. The laser driving circuit 20 controls, for example, luminance (brightness) of a laser light beam for drawing an image corresponding to the projection image signal. The laser driving circuit 20 includes, for example: a driving circuit 21A that drives the light source 31A; a driving circuit 21B that drives the light source 31B; and a driving circuit 21C that drives the light source 31C. The light sources 31A, 31B, and 31C each emit, for example, a laser light beam in the near-infrared region (700 nm to 2500 nm). The light source 31A is, for example, a laser diode that emits a laser light beam La having a light emission wavelength λ1. The light source 31B is, for example, a laser diode that emits a laser light beam Lb having a light emission wavelength λ2. The light source 31C is, for example, a laser diode that emits a laser light beam Lc having a light emission wavelength λ3. The light emission wavelengths λ1 and λ2 satisfy, for example, the following condition 1 (Expression (1) and Expression (2)). The light emission wavelengths λ2 and λ3 may satisfy, for example, the following condition 2 (Expression (3) and Expression (4)).

Condition 1

$$\lambda a2<\lambda 1<\lambda a1 \quad (1)$$

$$\lambda a3<\lambda 2<\lambda a2 \quad (2)$$

Condition 2

$$\lambda a1-10\text{ nm}<\lambda 3<\lambda a1+10\text{ nm} \quad (3)$$

$$\lambda a3<\lambda 2<\lambda a2 \quad (4)$$

Here, λa1 is, for example, an absorption wavelength (an absorption-peak wavelength) of the recording layer 112M and is 880 nm, for example. λa2 is an absorption wavelength of the recording layer 112C to be described later, and is 790 nm, for example. λa3 is an absorption wavelength (an absorption-peak wavelength) of the recording layer 112Y to be described later, and is 915 nm, for example. It is to be noted that "±10 nm" in Expression (3) means an allowable error range. In a case where the light emission wavelengths λ1 and λ2 satisfy the above condition 1, the light emission wavelength λ1 is, for example, 880 nm, and the light emission wavelength λ2 is, for example, 790 nm. In a case where the light emission wavelengths λ1 and λ2 satisfy the above condition 2, the light emission wavelength λ1 is, for example, 950 nm, and the light emission wavelength λ2 is, for example, 790 nm.

The light source section 30 includes light sources to be used for writing information on the heat-sensitive recording medium 100. The light source section 30 includes, for example, three light sources 31A, 31B, and 31C.

The multiplexer 40 has, for example, two reflection mirrors 41*a* and 41*d*, and two dichroic mirrors 41*b* and 41*c*. The laser light beams La, Lb, and Lc emitted from the light sources 31A, 31B, and 31C, respectively, are converted into substantially parallel light (collimated light) by a collimating lens. Thereafter, for example, the laser light beam La is reflected by the reflection mirror 41*a* and further reflected by the dichroic mirror 41*b*. The laser light beam Lb passes through the dichroic mirrors 41*b* and 41*c*. The laser light beam Lc is reflected by the reflection mirror 41*d* and is further reflected by the dichroic mirror 41*c*. Thus, the laser light beam La, the laser light beam Lb, and the laser light beam Lc are multiplexed. The multiplexer 40 outputs, for example, multiplexed light Lm obtained by the multiplexing to the scanner section 50.

The scanner section 50 scans, for example, the multiplexed light Lm outputted from the multiplexer 40 on a surface of the heat-sensitive recording medium 100 in a line-sequential manner. The scanner section 50 includes, for example, a two-axis scanner 51 and an fθ lens 52. The two-axis scanner 51 is, for example, a galvanometer mirror. The fθ lens 52 converts a constant velocity rotational motion by the two-axis scanner 51 into a constant velocity linear motion of a spot moving on the focal plane (the surface of the heat-sensitive recording medium 100).

The scanner driving circuit 60 drives the scanner section 50, for example, in synchronization with the projection image clock signal inputted from the signal processing circuit 10. Further, in a case where the a signal of an irradiation angle of the two-axis scanner 51 or the like is inputted from the from scanner section 50, the scanner driving circuit 60 drives the scanner section 50 to cause the irradiation angle to be a desired irradiation angle on the basis of the signal.

The detector 70 detects a drawn image drawn on the heat-sensitive recording medium 100. Specifically, the detector 70 detects, for example, the drawn image drawn in the first regions A1, A2, . . . , and An in step S101 (step S102).

The corrector 80 compares image information of the drawn image detected by the detector 70 to image information of an input image to calculate differences between the drawn image and the input image, and determines recording intensities on the basis of the differences. Specifically, the corrector 80 calculates differences between the image information of the drawn image of the first regions A1, A2, . . . , and An detected in step S102 and the image information of the input image, and determines, on the basis of the differences, the recording intensities to the second regions B1, B2, . . . , and Bn (step S103). The recording intensities determined by the corrector 80 are outputted as the drawing signal D2*in* to the signal processing circuit 10.

(1-3. Method of Drawing on Heat-Sensitive Recording Medium)

Next, a method of drawing on the heat-sensitive recording medium (the heat-sensitive recording medium 100) according to the present embodiment will be described with reference to FIG. 1, FIG. 5, FIG. 6A, and FIG. 6B.

First, the heat-sensitive recording medium 100 is prepared and set in the drawing device 1. Next, the signal processing circuit 10 selects a light source to be driven on the basis of a signal (a drawing signal D1*in*) of an input image (e.g., an input image D1 illustrated in FIG. 5). The signal processing circuit 10 generates a projection image signal for driving the light source selected on the basis of the drawing signal D1*in*. The signal processing circuit 10 outputs the generated projection image signal to the laser driving circuit 20 to control the light source section 30. Thus, for example, multiplexed light Lm1 obtained by appropriately multiplexing the laser light beam La having a light emission wavelength of 760 nm, the laser light beam Lb having a light emission wavelength of 860 nm, and the laser light beam Lc having a light emission wavelength of 915 nm is applied from the set of the drawing device 1 to some of the regions (the first regions A1, A2, . . . , and An) of the heat-sensitive recording medium 100. As a result, as illustrated in FIG. 6A, the drawing based on the drawing signal D1*in* is performed in the first regions A1, A2, . . . , and An by color mixture of magenta, cyan, and yellow (step S101).

Next, the drawn image of the first regions A1, A2, . . . , and An is detected by the detector 70 (step S102). The thus obtained image information of the drawn image of the first regions A1, A2, . . . , and An is outputted to the corrector 80. It is to be noted that upon detecting the drawn image, for example, a light source may be turned on. Alternatively, a window having a light-transmissivity for capturing external light may be provided to the drawing device 1, and the external light entering from the window may be used.

Next, the corrector 80 compares the image information of the drawn image of the first regions A1, A2, . . . , and An to the image information of the input image to calculate the differences between the drawn image and the input image D1 (step S103). The corrector 80 determines, on the basis of the differences, recording intensities to the remaining regions (the second regions B1, B2, . . . , and Bn) on which the drawing have not been performed in step S101. The determined recording intensities are outputted as the drawing signal D2*in* to the signal processing circuit 10.

The signal processing circuit 10 selects a light source to be driven on the basis of the drawing signal D2*in* inputted from the corrector 80. The signal processing circuit 10 generates a projection image signal for driving the light source selected on the basis of the drawing signal D2*in*. The signal processing circuit 10 outputs the generated projection image signal to the laser driving circuit 20 to control the light source section 30. Thus, for example, multiplexed light Lm2 obtained by appropriately multiplexing the laser light beam La having a light emission wavelength of 760 nm, the laser light beam Lb having a light emission wavelength of 860 nm, and the laser light beam Lc having a light emission wavelength of 915 nm is applied from the set of the drawing device 1 to the second regions B1, B2, . . . , and Bn of the heat-sensitive recording medium 100. As a result, as illustrated in FIG. 6B, the drawing based on the drawing signal D2*in* is performed in the second regions B1, B2, . . . , and Bn that are adjacent to the first regions A1, A2, . . . , and An, respectively, by color mixture of magenta, cyan, and yellow (step S1014).

Hereinafter, a specific example of the drawing method described above will be described with reference to FIGS. 7, 10 and 11.

In FIG. 7, the input image D1 is divided into, for example, 24 blocks, and gradations of magenta of the respective blocks are illustrated. Here, it is assumed that the input image D1 is represented by 255 levels of gray-scale data (255 gradations), and gradations of cyan and yellow, other than magenta, are not changed.

In the present embodiment, for example, the 24 blocks of the input image D1 illustrated in FIG. 7 are each further divided into two in a vertical direction, and the upper portions thereof are set as the first regions A and the lower portions thereof are set as the second regions B, and as described above, the multiplexed light Lm1 obtained by appropriately performing the multiplexing on the basis of the drawing signal D1*in* of the input image D1 is applied to each of the first regions A (A1, A2, . . . , and An) of the upper portions of the respective blocks.

Incidentally, in the drawing on the heat-sensitive recording medium, as described above, there is a case where hue deviation from an assumed image may occur due to variations in a recording device, deviations from a design of the heat-sensitive recording medium, and the like. FIG. 8 illustrates variation in a laser intensity with respect to a main scanning direction as an exemplary variation of the recording device. FIG. 9 illustrates variations in a thickness of a recording layer with respect to a main scanning direction as an example of deviations from the design of the heat-sensitive recording medium. Here, the main scanning direction is, for example, the X-axis direction in FIG. 7, and proceeds from the left end to the right end in the drawing.

In a case where the laser intensity at the start of drawing is low as illustrated in FIG. 8, or in a case where the thickness of the recording layer 112 at the start point of drawing is small as illustrated in FIG. 9, even if the gradation of magenta is set to 65 in the drawing signal D1*in*, the gradation of magenta actually drawn in the corresponding region is smaller than 65. Specifically, as illustrated in FIG. 6A, a gradient is formed from the drawing starting point (for example, X-1 of the first region A1 (a block A1-1, hereinafter, it is assumed that X represents a corresponding region number)) to a block whose laser intensity or thickness of the recording layer 112 becomes a set value (for example, X-5 of the first region A1 (a block A1-5)), for example.

The detector 70 detects the drawn image drawn in the first regions A1, A2, . . . , and An as gradations for the respective blocks. FIG. 10 illustrates gradations of magenta in the respective blocks of the drawn image of the first regions A1, A2, . . . , and An illustrated in FIG. 6A. The magenta gradations in the respective blocks gradually increase in the following order, starting from the left end, which is the drawing starting point, 25 (e.g., block A1-1), 35 (e.g., block A1-2), 45 (e.g., block A1-3), 55 (e.g., block A1-4), and then 65 in the fifth block from the left (e.g., block A1-5), which is the same gradation as the input image D1. The detector 70 outputs the gradations of the respective blocks (e.g., the blocks A1-1, A1-2, . . . , and A1-8) of the first regions A1, A2, . . . , and An to the corrector 80 as the image information of the first regions A1, A2, . . . , and An.

The corrector 80 calculates differences between: the respective blocks (e.g., the blocks A1-1, A1-2, . . . , and A1-8) of the first regions A1, A2, . . . , and An; and the input image D1, on the basis of gradation information of the blocks (e.g., the blocks A1-1, A1-2, . . . , and A1-8) of the first regions A1, A2, . . . , and An inputted from the detector 70 and gradation information of a corresponding block of the input image D1. On the basis of the results, gradation information of the blocks (e.g., blocks B1-1, B1-2, . . . , and B1-8) of the second regions B1, B2, . . . , and Bn necessary for obtaining the gradations of the input image D1 in the blocks (X-1, X-2, . . . , and X-8) is calculated.

FIG. 11 illustrates gradations demanded for the blocks (e.g., the blocks B1-1, B1-2, . . . , and B1-8) of the second regions B1, B2, . . . , and Bn to obtain a drawn image substantially equal to the input image D1. For example, as illustrated in FIG. 7, in a case where the gradation of magenta of the input image D1 in the block X-1 is 65 and the gradation of magenta in the first region A (the block A1-1) in the upper portion of the block X-1 is 25, the gradation at which the second region B (the block B1-1) in the lower portion of the block is drawn is 105.

The corrector 80 further determines recording intensities for the blocks (e.g., the blocks B1-1, B1-2, . . . , and B1-8) of the second regions B1, B2, . . . , and Bn, on the basis of the gradation information of the blocks (e.g., the blocks B1-1, B1-2, . . . , and B1-8) of the second regions B1, B2, . . . , and Bn calculated above.

FIG. 12 illustrates a relationship between: a laser intensity; and an assumed gradation (theoretical gradation) and a gradation (actual gradation) at which drawing is assumed to be actually performed. FIG. 12 indicates a deviation between a set value obtained from a result of the drawn image of the first regions A1, A2, . . . , and An and an actual drawing condition. For example, when drawing was performed at a laser intensity P1 in order to obtain the gradation of 65, the gradation actually drawn was 25. From this, it is estimated that the relationship between the laser intensity and the gradation of the drawing device 1 actually corresponds to a dotted line. Therefore, in order to obtain the gradation of magenta of 65 in the block X-1 of the heat-sensitive recording medium 100, it is necessary that the gradation of magenta in the block X-1 (the block B1-1) of the second region B be 105, and the laser intensity necessary for drawing the gradation of magenta of 105 is P2 from FIG. 12. The above is calculated for each of the blocks X-1, X-2, . . . , and X-8, and the optimal laser intensity for drawing on each of the blocks (e.g., the blocks B1-1, B1-2, . . . , and B1-8) of the second regions B1, B2, . . . , and Bn is determined. The corrector 80 outputs, to the signal processing circuit 10, the optimal laser intensities for drawing on the blocks (e.g., the blocks B1-1, B1-2, . . . , and B1-8) of the second regions B1, B2, . . . , and Bn as the drawing signal D2*in*.

Through the above, the signal processing circuit 10 applies the multiplexed light Lm2 obtained by appropriately performing multiplexing on the basis of the drawing signal D2*in* inputted from the corrector 80 to each of the second regions B (B1, B2, . . . , and Bn) of the lower portions of the respective blocks X-1, X-2, . . . , and X-8).

As described above, the heat-sensitive recording medium 100, as illustrated in FIG. 2, has striped regions in which the first regions A and the second regions B of mutually differing gradation alternately adjoin each other, at least in a portion. Specifically, a drawn image is formed in which a color difference ($\Delta a1-b1$) between a first region A (e.g., a1 in the first region A1 of FIG. 2) and a second region B (e.g., b1 in the second region B1 of FIG. 2) that are adjacent to each other on a straight line in another direction perpendicular to one direction is larger than a color difference ($\Delta a1-a2$) between first regions (e.g., a1 in the first region A1 and a2 in the first region A2 of FIG. 2) that are adjacent to each other on the straight line in the other direction. Further, a drawn image is formed in which a color difference (Δa1−b1) between a1 of the first region A1 and b1 of the second region B1 is larger than, for example, a color difference (Δa1−a3) between a1 of the first region A1 and a3 apart from a1 in the same first region A1 by a width in one direction (the X-axis direction) of the first region A1.

It is to be noted that, by setting the widths of the first regions A and the second regions B to be less than or equal to the resolution of the human eye (e.g., 500 μm or less), a drawn image substantially equal to the input image D1 is formed in the heat-sensitive recording medium 100. It is to be noted that the lower limit of the widths of the first regions A and the second regions B are not particularly limited; however, the width that is possible to be drawn is, for example, 10 μm.

(1-4. Workings and Effects)

As described above, a heat-sensitive recording medium has recently been developed which includes a recording layer containing a heat-sensitive color developing composition and a photothermal conversion agent that absorbs infrared wavelength light. As an example, there has been proposed a heat-sensitive recording medium in which a plurality of recording layers respectively including photothermal conversion agents that absorb infrared rays of different wavelengths is included, and, by applying infrared laser light that matches an absorption wavelength of a photothermal conversion agent, the corresponding photothermal conversion agent absorbs the laser light to cause a recording layer including the photothermal conversion agent to develop a color. Such a heat-sensitive recording medium adjusts drawing widths by changing laser intensities to expresses desired gradations.

However, in a case where recording is performed on the above-described heat-sensitive recording medium, there is an issue in that hue deviation from an assumed image occurs due to variations in a recording device, deviations from a design of the heat-sensitive recording medium, and the like. In particular, in a reversible recording medium which includes a leuco dye as the heat-sensitive color developing composition and which enables information to be recorded and deleted reversibly by heat by being combined with a color developing/quenching agent and a photothermal conversion agent, the sensitivity changes every time the information is rewritten due to deterioration of a material of the photothermal conversion agent or the like.

In contrast, the drawing method according to the present embodiment includes, on the heat-sensitive recording medium 100: first, performing drawing in the plurality of first regions A1, A2, . . . , and An on the basis of the input image D1, the plurality of first regions A1, A2, . . . , and An each extending in one direction and having gaps therebetween; and thereafter detecting recorded states of the first regions A1, A2, . . . , and An, calculating differences from the input image, and performing drawing in the second regions B1, B2, . . . , Bn at recording intensities determined on the basis of the differences, the second regions B1, B2, . . . , Bn being provided between the first regions A1, A2, . . . , and An and each extending in the one direction. This makes it possible to decrease hue deviation from the input image due to variations in a recording device, deviations from a design of the medium, and the like.

In the recording layer 112 of the heat-sensitive recording medium 100 on which the drawing is performed by the above drawing method, as described above, a drawn image is formed in which a color difference (Δa1−b1) between a first region A (e.g., a1 in the first region A1 of FIG. 2) and a second region B (e.g., b1 in the second region B1 of FIG. 2) that are adjacent to each other on a straight line in another direction perpendicular to one direction is larger than a color difference (Δa1−a2) between first regions (e.g., a1 in the first region A1 and a2 in the first region A2 of FIG. 2) that are adjacent to each other on the straight line in the other direction.

As described above, in the present embodiment, first, the drawing is performed in some of the regions of the heat-sensitive recording medium 100 (e.g., the first regions A1, A2, . . . , and An each extending in one direction and having gaps therebetween) on the basis of the drawing signal D1*in* of the input image D1, thereafter differences between the drawn image and the input image are calculated, and the drawing is performed in the remaining regions (e.g., the second regions B1, B2, . . . , and Bn between the first regions A1, A2, . . . , and An and each extending in the one direction) at recording intensities that are determined on the basis of the differences. Thus, the hue deviation from the input image is reduced and it becomes possible to improve display quality.

Further, in the present embodiment, as described above, it is not necessary to output a gradation-correction images (so-called trial printing) before actual drawing. Further, in the drawing method where gradation correction is performed by the trial printing as described above, it is not possible to cope with a printing medium whose sensitivity changes by repetition of writing and deleting, such as a reversible recording medium. However, the drawing method of the present embodiment is able to be applied to all recording media on which laser drawing is to be performed.

Next, description is given of a second embodiment according to the present disclosure. In the following, components similar to those of the foregoing first embodiment are denoted by the same reference numerals, and descriptions thereof are omitted where appropriate.

2. Second Embodiment

FIG. 13 illustrates a flow of a drawing method to be performed on the heat-sensitive recording medium (the heat-sensitive recording medium 100) according to a second embodiment of the present disclosure. FIGS. 14A to 14C illustrate an example of drawing processes to be performed on the heat-sensitive recording medium 100 using the drawing method illustrated in FIG. 13. FIGS. 15A to 15C illustrate another example of the drawing process to be performed on the heat-sensitive recording medium 100 using drawing method illustrated in FIG. 13. The drawing method according to the present embodiment differs from the first embodiment in that the differences are calculated and corrected a plurality of times (twice in the present embodiment).

Hereinafter, the drawing method to be performed on the heat-sensitive recording medium 100 according to the present embodiment will be described with reference to FIGS. 1, 14A to 14C, and 15A to 15C.

First, the heat-sensitive recording medium 100 is prepared and set in the drawing device 1. Next, the signal processing circuit 10 selects a light source to be driven on the basis of a signal (a drawing signal D1*in*) of an input image (e.g., an input image D1 illustrated in FIG. 5). The signal processing circuit 10 generates a projection image signal for driving the light source selected on the basis of the drawing signal D1*in*. The signal processing circuit 10 outputs the generated projection image signal to the laser driving circuit 20 to control the light source section 30. Thus, for example, multiplexed light Lm1 obtained by appropriately multiplexing the laser light beam La having a light emission wavelength of 760 nm, the laser light beam Lb having a light emission wavelength of 860 nm, and the laser light beam Lc having a light emission wavelength of 915 nm is applied from the set of the drawing device 1 to some of the regions (the first regions A1, A2, . . . , and An) of the heat-sensitive recording medium 100. As a result, the drawing having gradations illustrated in FIGS. 14A and 15A is performed in the first regions A1, A2, . . . , and An by color mixture of magenta, cyan, and yellow (step S201).

Next, the detector 70 detects the drawn image of the first regions A1, A2, . . . , and An is detected (step S202). The thus obtained image information of the drawn image of the first regions A1, A2, . . . , and An is outputted to the corrector 80.

Next, the corrector 80 compares the image information of the drawn image of the first regions A1, A2, . . . , and An to the image information of the input image to calculate the differences between the drawn image and the input image D1 (step S203). The corrector 80 determines, on the basis of the differences, recording intensities to the remaining regions (the second regions B1, B2, . . . , and Bn) on which the drawing has not been performed in step S201. The determined recording intensities are outputted as the drawing signal D2*in* to the signal processing circuit 10.

The signal processing circuit 10 selects a light source to be driven on the basis of the drawing signal D2*in* inputted from the corrector 80. The signal processing circuit 10 generates a projection image signal for driving the light source selected on the basis of the drawing signal D2*in*. The signal processing circuit 10 outputs the generated projection image signal to the laser driving circuit 20 to control the light source section 30. Thus, for example, the multiplexed light Lm2 obtained by appropriately multiplexing the laser light beam La having a light emission wavelength of 760 nm, the laser light beam Lb having a light emission wavelength of 860 nm, and the laser light beam Lc having a light emission wavelength of 915 nm is applied from the set of the drawing device 1 to the second regions B1, B2, . . . , and Bn of the heat-sensitive recording medium 100. As a result, the drawing having gradations illustrated FIGS. 14B and 15B is performed in the second regions B1, B2, . . . , and Bn that are adjacent to the first regions A1, A2, . . . , and An, respectively (step S204).

Next, the detector 70 detects a drawn image of the first regions A1, A2, . . . , and An and the second regions B1, B2, . . . , and Bn (step S205). The thus obtained image information of the drawn image of the first regions A1, A2, . . . , and An and the second regions B1, B2, . . . , and Bn is outputted to the corrector 80.

Next, the corrector 80 compares the image information of the drawn image of the first regions A1, A2, . . . , and An and the second regions B1, B2, . . . , and Bn to the image information of the input image to calculate differences between the drawn image and the input image D1 (step S206). The corrector 80 determines, on the basis of the differences, recording intensities to the remaining regions (third regions C1, C2, . . . , and Cn) on which the drawing has not been performed in step S201 and step S204. The determined recording intensities are outputted as a drawing signal D3*in* to the signal processing circuit 10.

The signal processing circuit 10 selects a light source to be driven on the basis of the drawing signal D3*in* inputted from the corrector 80. The signal processing circuit 10 generates a projection image signal for driving the selected light source on the basis of the drawing signal D3*in*. The signal processing circuit 10 outputs the generated projection image signal to the laser driving circuit 20 to control the light source section 30. Thus, for example, multiplexed light Lm3 obtained by appropriately multiplexing the laser light beam La having a light emission wavelength of 760 nm, the laser light beam Lb having a light emission wavelength of 860 nm, and the laser light beam Lc having a light emission wavelength of 915 nm is applied from the set of the drawing device 1 to the third regions C1, C2, . . . , and Cn of the heat-sensitive recording medium 100. As a result, drawing having predetermined gradations is performed in the third regions C1, C2, . . . , and Cn that are adjacent to the first regions A1, A2, . . . , and An and the second regions B1, B2, . . . , and Bn, respectively (step S207). At this time, as illustrated in FIG. 14B, in a case where the correction is completed by the drawing performed in the second regions B1, B2, . . . , and Bn, the drawing is performed in the third regions C1, C2, . . . , and Cn at the gradation of 65 of the input image D1. As illustrated in FIG. 15C, in a case where the correction is inadequate in the drawing performed in the second regions B1, B2, . . . , and Bn, drawing having gradations of correcting the correction is performed.

Thus, the differences between drawn image and the input image may be calculated and corrected twice or more. As a result, even in a case where there is a remarkable difference between a theoretical gradation and an actual gradation, an advantageous effect is achieved that it becomes possible to further increase the accuracy of gradation correction.

3. Application Example

Next, description is given of application examples of the heat-sensitive recording medium 100 described in the foregoing first and second embodiments. However, a configuration of an electronic apparatus described below is merely exemplary, and the configuration may be varied appropriately. The heat-sensitive recording medium 100 is applicable to a portion of various electronic apparatuses or various clothing accessories. For example, the heat-sensitive recording medium 100 is applicable to a portion of clothing accessories such as a watch (wristwatch), a bag, clothes, a hat, a helmet, headphones, glasses, and shoes, as a so-called wearable terminal. In addition, the type of the electronic apparatus is not particularly limited, and examples include a wearable display such as a head-up display or a head-mounted display, a portable device such as a portable music player or a portable game machine, a robot, a refrigerator, a washing machine, and the like. Further, it is also possible to apply, not only to the electronic apparatuses or the clothing accessories, but also to, as decorative members, the interior and exterior of automobiles, the interior and exterior of walls and the like of buildings, the exterior of furniture such as desks, and the like.

Application Example 1

FIGS. 16A and 16B each illustrate an appearance of an integrated circuit (IC) card with a rewritable function. The IC card has a card surface that serves as a printing surface 210, and includes, for example, a sheet-shaped heat-sensitive recording medium 100, etc. that is adhered thereto. The IC card allows for drawing on the printing surface 210 as well as rewriting and deletion thereof appropriately by disposing the heat-sensitive recording medium 100, etc. on the printing surface, as illustrated in FIGS. 16A and 16B.

Application Example 2

FIG. 17A illustrates a configuration of an appearance of a front surface of a smartphone, and FIG. 17B illustrates a configuration of an appearance of a rear surface of the smartphone illustrated in FIG. 17A. The smartphone includes, for example, a display part 310, a non-display part 320, and a casing 330. An entire surface, for example, of the casing 330 on side of the rear surface is provided with, for example, the heat-sensitive recording medium 100, etc. as the exterior member of the casing 330. This allows for display of various color patterns as illustrated in FIG. 17B. It is to be noted that, although the smartphone is exemplified here, this is not limitative; it is also possible to apply, for example, to a notebook personal computer (PC), a tablet PC, or the like.

Application Example 3

FIGS. 18A and 18B each illustrate an appearance of a bag. The bag includes a storing part 410 and a handle 420, for example, and the heat-sensitive recording medium 100, for example, is attached to the storing part 410. Various letters and patterns are displayed on the storing part 410 by means of the heat-sensitive recording medium 100, for example. The attachment of the heat-sensitive recording medium 100, etc. to a part of the handle 420 allows for display of various color patterns, and allows for change in design of the storing part 410, as illustrated, from the example of FIG. 18A to the example of FIG. 18B. It is also possible, for the purpose of fashion, to achieve a useful electronic device.

Application Example 4

FIG. 19 illustrates a configuration example of a wristband able to record, in an amusement park, attraction-riding history, schedule information, and the like, for example. The wristband includes belt parts 511 and 512 and an information recording layer 520. The belt parts 511 and 512 have a band shape, for example, and respective ends (unillustrated) thereof are configured to be connectable to each other. The heat-sensitive recording medium 100, etc., for example, is adhered to the information recording layer 520, and attraction-riding history MH2 and schedule information IS (IS1 to IS3) as described above and an information code CD, for example, are recorded. In the amusement park, a visitor is able to record the above-described information by waving the wristband over a drawing apparatus installed at every location of attraction-riding reservation spots.

A riding history mark MH1 indicates the number of attractions ridden by a visitor who wears the wristband in the amusement park. In this example, as the visitor rides the more attractions, the more star-shaped marks are recorded as the riding history mark MH1. It is to be noted that this is not limitative; for example, the color of the mark may be changed in accordance with the number of attractions ridden by the visitor.

The schedule information IS in this example indicates a schedule of the visitor. In this example, information about all of events including an event reserved by the visitor and an event to be held in the amusement park is recorded as the schedule information IS1 to IS3. Specifically, in this example, a title of an attraction (an attraction 201) of which riding reserved by the visitor and scheduled time of the riding are recorded as the schedule information IS1. Further, an event such as a parade in the park and its scheduled starting time are recorded as the schedule information IS2. Furthermore, a restaurant reserved beforehand by a visitor and its scheduled mealtime are recorded as the schedule information IS3.

The information code CD records, for example, identification information IID that is used to identify the wristband and website information IWS.

Application Example 5

FIG. 20A illustrates an appearance of an upper surface of an automobile, and FIG. 20B illustrates an appearance of a side surface of the automobile. The heat-sensitive recording medium 100 or the like according to the present disclosure, as described above, may be provided, for example, to a vehicle body such as a bonnet 611, a bumper 612, a roof 613, a trunk cover 614, a front door 615, a rear door 616, or a rear bumper 617, thereby enabling various information and color patterns to be displayed in each part. The heat-sensitive recording medium 100 or the like is provided on the interior of the automobile, for example, on a steering wheel, a dashboard, or the like, thereby enabling various colors to be displayed.

Although the present disclosure has been described above with reference to the first and second embodiments, the present disclosure is not limited to aspects described in the foregoing embodiments, etc., and may be modified in a variety of ways. For example, not all the components described in the foregoing embodiments, etc. may necessarily be provided, and any other component may be further included. Moreover, the materials and the thicknesses of the above-described components are merely examples, and are not limited to those described herein.

Further, in the first embodiment, an example is shown in which the recording layer 112 (the recording layer 112M in FIG. 3) is provided directly on the support base 111; however, for example, a layer having a structure similar to that of the intermediate layer 113 may be added between the support base 111 and the recording layer 112M.

In addition, in the first embodiment, an example is shown of the heat-sensitive recording medium 100 in which three recording layers 112 (112M, 112C, and 112Y) to be colored in colors different from each other are stacked with the intermediate layers 113 and 114 interposed therebetween, but the present disclosure is not limited thereto. For example, a reversible recording medium that enables multicolor display in a single-layer structure may be used, in which three types of coloring compounds to be colored in colors different from each other and each enclosed in a microcapsule are mixed, for example. Still further, the present disclosure is not limited to the microcapsule, and for example, a reversible recording medium including a recording layer having a fiber-shaped three-dimensional stereoscopic structure. For example, the fiber to be used here preferably has a so-called core-sheath structure configured by a core part that includes the coloring compound to be colored in a desired color, the color developing/quenching agent corresponding thereto, and the photothermal conversion agent, and by a sheath part that coats the core part and is configured by a heat-insulating material. By forming the three-dimensional stereoscopic structure using a plurality of types of fibers having the core-sheath structure and including respective coloring compounds to be colored in different colors, it becomes possible to produce a reversible recording medium that enables multicolor display.

In addition, in the above embodiments and the like, the heat-sensitive recording medium 100 that enables information to be recorded and deleted reversibly is exemplified as a heat-sensitive recording medium, but the present technology is not limited to a recording medium that enables information to be recorded and deleted reversibly, and is able to be applied to all recording media on which laser drawing is to be performed in a non-contact manner.

It is to be noted that the present disclosure may have the following configurations. According to the present technology having the following configurations, the following is performed on a heat-sensitive recording medium including a recording layer containing a leuco dye and a photothermal conversion agent that absorbs infrared wavelength light to generate heat: performing drawing, on the basis of an input image, in a plurality of first regions extending in one direction and having gaps therebetween; and thereafter detecting recorded states of the plurality of first regions, calculating differences from the input image, and performing drawing in a plurality of second regions at recording intensities determined on the basis of the differences, the plurality of second regions extending in the one direction and being provided at the respective gaps between the plurality of first regions. This decreases hue deviation from the input image due to variations in a recording device, deviations from a design of a medium, and the like, and makes it possible to improve display quality. Thus, on the heat-sensitive recording medium, an image is drawn in which a first color difference between a first region and a second region that are adjacent to each other on a straight line in another direction perpendicular to the one direction is larger than a second color difference between first regions that are adjacent to each other on the straight line in the other direction. It is to be noted that the effects described herein are not necessarily limiting, and any of the effects described in the present disclosure may be provided.

(1)

A drawing method to be performed on a heat-sensitive recording medium including a recording layer, the recording layer containing a leuco dye and a photothermal conversion agent that absorbs infrared wavelength light, the drawing method including:

performing drawing in a plurality of first regions, the plurality of first regions each extending in one direction and having gaps therebetween; and thereafter detecting recorded states of the plurality of first regions, calculating differences from the input image information, and performing drawing in a plurality of second regions at recording intensities determined on a basis of the differences, the plurality of second regions each extending in the one direction and being provided at the gaps between the plurality of first regions.

(2)

The drawing method according to (1), in which the drawing in the plurality of first regions and the drawing in the plurality of second regions are each performed using a light beam.

(3)

The drawing method according to (2), in which the recording intensities are each adjusted by an output of the light beam.

(4)

The drawing method according to any one of (1) to (3), including:

performing drawing in the plurality of second regions; and thereafter detecting recorded states of the plurality of first regions and the plurality of second regions, calculating differences from the input image information, and performing drawing in a plurality of third regions at recording intensities determined on a basis of the differences, the plurality of third regions each extending in the one direction and being provided between the plurality of first regions and the plurality of second regions.

(5)

A heat-sensitive recording medium including a recording layer containing a leuco dye and a photothermal conversion agent that absorbs infrared wavelength light, in which the recording layer includes a plurality of first regions each extending in one direction and having gaps therebetween, and a plurality of second regions each extending in the one direction and being provided at the gaps between the plurality of first regions, and a first color difference between the first region and the second region that are adjacent to each other on a straight line in another direction perpendicular to the one direction is larger than a second color difference between the plurality of first regions that are adjacent to each other on the straight line in the other direction.

(6)

The heat-sensitive recording medium according to (5), in which a width in the other direction of each of the plurality of first regions and the plurality of second regions is 10 μm or more and 500 μm or less.

(7)

The heat-sensitive recording medium according to (5) or (6), in which the first color difference is larger than a third color difference between two points, the two points being apart from each other on a straight line in the one direction in the first region by a width in the other direction of the plurality of first regions.

(8)

The heat-sensitive recording medium according to any one of (5) to (7), further including third regions each extending in the one direction between the plurality of first regions and the plurality of second regions, and having a fourth color difference that is different from the first color difference and the second color difference on the straight line in the other direction perpendicular to the one direction.

(9)

The heat-sensitive recording medium according to any one of (5) to (8), in which the recording layer further includes a color developing/quenching agent, and the leuco dye, the color developing/quenching agent, and the photothermal conversion agent are dispersed in a macromolecular material.

(10)

A drawing device including:

a light source section that emits a light beam;

a scanner section that performs drawing, on a recording layer containing a leuco dye and a photothermal conversion agent that absorbs infrared wavelength light to generate heat, by scanning the light beam emitted from the light source section in a plurality of first regions and a plurality of second regions, the plurality of first regions each extending in one direction and having gaps therebetween, the plurality of second regions each extending in the one direction and being provided at the gaps between the plurality of first regions;

a detector that detects a recorded state of the recording layer; and a corrector that determines a recording intensity on a basis of a result obtained by the detector, in which the scanner section performs scanning in the plurality of first regions on a basis of input image information, the detector detects recorded states of the plurality of first regions in which drawing has been performed by the scanner section, and outputs, as image information of the plurality of first regions, the recorded states of the plurality of first regions to the corrector, the corrector calculates differences between the image information of the plurality of first regions inputted from the detector and the input image information, and determines, on a basis of the differences, recording intensities of drawing on the plurality of second regions, and the scanner section performs scanning in the plurality of second regions using the recording intensities determined by the corrector.

This application claims the benefit of Japanese Priority Patent Application JP2018-170076 filed with the Japan Patent Office on Sep. 11, 2018, the entire contents of which are incorporated herein by reference.

It should be understood by those skilled in the art that various modifications, combinations, sub-combinations, and alterations may occur depending on design requirements and other factors insofar as they are within the scope of the appended claims or the equivalents thereof.

The invention claimed is:

1. A drawing method to be performed on a heat-sensitive recording medium including a recording layer, the recording layer containing a leuco dye and a photothermal conversion agent that absorbs infrared wavelength light, the drawing method comprising:

performing drawing in a plurality of first regions, the plurality of first regions each extending in one direction and having gaps therebetween; and thereafter detecting recorded states of the plurality of first regions, calculating differences from the input image information, and performing drawing in a plurality of second regions at recording intensities determined on a basis of the differences, the plurality of second regions each extending in the one direction and being provided at the gaps between the plurality of first regions.

2. The drawing method according to claim 1, wherein the drawing in the plurality of first regions and the drawing in the plurality of second regions are each performed using a light beam.

3. The drawing method according to claim 2, wherein the recording intensities are each adjusted by an output of the light beam.

4. The drawing method according to claim 1, comprising:

performing drawing in a plurality of third regions at recording intensities determined on a basis of the differences, the plurality of third regions each extending in the one direction and each of the plurality of third regions being provided between the plurality of first regions and the plurality of second regions.

5. A drawing device comprising:

a light source section that emits a light beam;

a scanner section that performs drawing, on a recording layer containing a leuco dye and a photothermal conversion agent that absorbs infrared wavelength light to generate heat, by scanning the light beam emitted from the light source section in a plurality of first regions and a plurality of second regions, the plurality of first regions each extending in one direction and having gaps therebetween, the plurality of second regions each extending in the one direction and being provided at the gaps between the plurality of first regions;

a detector that detects a recorded state of the recording layer; and a corrector that determines a recording intensity on a basis of a result obtained by the detector, wherein the scanner section performs scanning in the plurality of first regions on a basis of input image information, the detector detects recorded states of the plurality of first regions in which drawing has been performed by the scanner section, and outputs, as image information of the plurality of first regions, the recorded states of the plurality of first regions to the corrector, the corrector calculates differences between the image information of the plurality of first regions inputted from the detector and the input image information, and determines, on a basis of the differences, recording intensities of drawing on the plurality of second regions, and the scanner section performs scanning in the plurality of second regions using the recording intensities determined by the corrector.

* * * * *